US006370703B1

(12) United States Patent
Kim et al.

(10) Patent No.: US 6,370,703 B1
(45) Date of Patent: Apr. 16, 2002

(54) ODORLESS TOILET

(75) Inventors: Kyung Tae Kim, Albuquerque, NM (US); Kyung Hoon Kim, Fullerton, CA (US)

(73) Assignee: Kyung T. Kim, Laguna Niguel, CA (US)

( * ) Notice: Subject to any disclaimer, the term of this patent is extended or adjusted under 35 U.S.C. 154(b) by 0 days.

(21) Appl. No.: 09/570,838

(22) Filed: May 12, 2000

(51) Int. Cl.[7] ..... E03D 9/04

(52) U.S. Cl. ..... 4/216; 4/313; 4/325; 4/209 R

(58) Field of Search ..... 4/216, 313, 324, 4/325, 209 R, 211, 214, 217

(56) References Cited

U.S. PATENT DOCUMENTS

| | | | | |
|---|---|---|---|---|
| 1,013,616 A | | 1/1912 | Rumsey | |
| 2,724,838 A | | 11/1955 | Wirth et al. | |
| 3,335,431 A | | 8/1967 | Coates | |
| 3,574,866 A | | 4/1971 | Sievers | |
| 3,744,064 A | | 7/1973 | Preston | |
| 3,781,923 A | | 1/1974 | Maisch et al. | |
| 3,887,949 A | | 6/1975 | Osmond | |
| 3,943,577 A | | 3/1976 | Woolf et al. | |
| 4,031,574 A | | 6/1977 | Werner | |
| 4,087,868 A | | 5/1978 | Gentz | |
| 4,103,370 A | | 8/1978 | Armond | |
| 4,133,060 A | | 1/1979 | Webb | |
| 4,144,600 A | | 3/1979 | Mayes | |
| 4,183,108 A | * | 1/1980 | Hamilton | 4/354 |
| 4,318,192 A | | 3/1982 | Williams et al. | |
| 4,420,845 A | * | 12/1983 | Antunez | 4/366 |
| 4,570,272 A | * | 2/1986 | Kawaguchi et al. | 4/DIG. 3 |
| 4,800,596 A | | 1/1989 | Menge | |
| 4,853,981 A | | 8/1989 | Hunicutt, Jr. | |
| 4,864,664 A | | 9/1989 | Higgins | |
| 4,880,027 A | | 11/1989 | Menge | |
| 4,933,996 A | | 6/1990 | Sowards | |
| 4,980,932 A | * | 1/1991 | Stemples | 4/324 |
| 5,036,553 A | | 8/1991 | Sanderson | |
| 5,140,712 A | | 8/1992 | Wang-On | |
| 5,187,818 A | * | 2/1993 | Barrett, Sr. et al. | 4/313 |
| 5,201,079 A | | 4/1993 | Sowards | |
| 5,386,594 A | | 2/1995 | Hilton | |
| 5,560,048 A | | 10/1996 | Root | |
| 5,715,860 A | | 2/1998 | Horad | |
| 5,761,748 A | | 6/1998 | Smith et al. | |
| 5,813,060 A | | 9/1998 | Klopocinski | |

FOREIGN PATENT DOCUMENTS

| | | | | |
|---|---|---|---|---|
| EP | 0487977 A1 | * | 6/1992 | |
| JP | 2311629 A | * | 12/1990 | 4/209 R |

* cited by examiner

*Primary Examiner*—Gregory L. Huson
*Assistant Examiner*—Khoa D. Huynh
(74) *Attorney, Agent, or Firm*—Knobbe, Martens, Olson & Bear LLP

(57) ABSTRACT

A toilet includes a fan configured to draw gases from the toilet bowl into the sewer line. The toilet also includes a tank assembly configured so that the tank contains a low water volume prior to the act of a user sitting on the toilet seat, and a high water volume when and after the user sits on the toilet seat. The tank assembly includes a pivoting trap cover comprising a container with an open lower end. The trap cover has an interior separator, comprising a wall. In a lowered position of the trap cover, the separator establishes a water trap or seal between an interior chamber of the trap cover and an exhaust conduit from the tank to the sewer line. In a raised position of the trap cover, the separator permits air flow from the interior chamber of the trap cover into the exhaust conduit and down to the sewer. The tank assembly also includes a float valve configured to permit water to flow into the tank from a water supply. When a person is not sitting on the toilet seat, the float valve permits a low water volume in the tank. When a person sits on the seat, a fan is activated to increase air pressure in the trap cover, and/or to decrease air pressure inside a float of the float valve, via a venturi tube. The adjusted air pressure causes the float valve to open to permit a high water volume in the tank. The increased air pressure in the trap cover also causes the trap cover to rise to draw toilet bowl gases into the exhaust conduit.

35 Claims, 20 Drawing Sheets

ODORLESS TOILET

BACKGROUND OF THE INVENTION

1. Field of the Invention

The present invention relates to toilets and, in particular, to toilets including apparatus for odor removal.

2. Description of the Related Art

A typical toilet comprises a bowl configured to hold water that forms a water trap or seal between the bowl and a sewer line, and a tank configured to contain water to flush matter within the bowl to the sewer line. There are several methods that have been suggested to remove unpleasant odors from toilets. Typically, a fan or a fan assembly is provided to remove air from the toilet bowl. In one method, a fan draws air from the bowl and sends it to an external location, such as the outdoors. One disadvantage of this approach is that it requires an exhaust channel to an external location. Another disadvantage of this method is that the foul odors are exhausted to the environment, where they can annoy people.

Another method is to draw air from the bowl and blow it through an exhaust conduit to the sewer line. Generally, the universal plumbing code (UPC) requires that the exhaust conduit be sealed to prevent sewer gases from seeping back to the toilet and other above-ground areas. Various types of seals have been suggested for this purpose, such as one-way check valves, gate valves, and water traps in combination with valves. One disadvantage of existing seals is that they often entail the use of gaskets, O-ring seals, sliding valve elements, and other moving parts that wear and fail over time.

People flush toilets to dispose of human waste and other matter. Sometimes, particularly when people flush matter other than human waste down to the sewer, the entire volume of water within the tank is not required. For example, a person might use some tissue paper to blow his or her nose and then flush the tissue paper down to the sewer. In such cases, the utilization of the entire volume of water in the tank is wasteful.

Various methods have been proposed to conserve water associated with toilet use. In one method, the tank of the toilet includes a divider that divides the water in the tank into two sections. A user can select a complete flush, in which both sections are drained, or a partial flush, in which only one section is drained. Another method is to provide two drain ports for draining water from the tank for a flush. An upper port is positioned generally midway between the top and bottom of the tank. Opening the upper port causes only the water above the upper port level to drain into the bowl. A lower port is positioned substantially at the bottom of the tank. Opening the lower port causes substantially all of the tank water to drain into the bowl. Thus, the user can open the upper port for a partial flush or the lower port for a complete flush.

A disadvantage of these methods is that they require the user to operate a separate control for selecting a complete or partial flush. Some toilets employ a multi-function or dual-acting flush control. Other toilets use two separate controls. In either case, users must become accustomed to a different type of flush control.

SUMMARY OF THE INVENTION

Accordingly, it is a principle object and advantage of the present invention to overcome these limitations and to provide an improved toilet having odor-removing and water-conserving apparatus and capabilities.

In one aspect, the present invention provides a toilet that can have two different water volumes, a high water volume and a low water volume. The toilet can execute a high water volume flush when flushing human waste, and a low water volume flush when flushing other items. In this aspect, the toilet comprises a bowl, a seat generally above the bowl, a tank, an inlet valve, and a control system. The bowl has a lower opening configured to be fluidly connected to a sewer line. The tank is configured to contain water to flush matter within the bowl to the sewer line. The tank is also configured to be fluidly connected to a water supply. The inlet valve is configured to control the flow of water from the water supply into the tank. The control system is configured to control the inlet valve so that the tank contains a first stabilized volume of water before a person sits on the seat and a second stabilized volume of water after a person sits on the seat, wherein the second volume is greater than the first volume.

In another aspect, the present invention provides a toilet that acts to conserve water by sensing a person's presence on the toilet seat. In this aspect, the toilet comprises a bowl, a seat, and a tank, wherein the tank comprises an inlet configured to be connected to a water supply, an inlet valve, and a flapper valve. The inlet valve has a closed position in which the inlet valve prevents water from entering the tank through the inlet, and an open position in which the inlet valve permits water to enter the tank through the inlet. The flapper valve has a closed position in which water within the tank is prevented from entering the bowl, and an open position in which water within the tank is permitted to enter the bowl. The inlet valve is responsive to a person's presence on the seat and controls the volume of water in the tank depending upon whether a person is seated on the seat.

In another aspect, the present invention provides a toilet configured to remove unpleasant odors from the toilet area by causing gases from the toilet bowl to flow into a sewer line. In this aspect, the toilet comprises a bowl, a tank, a trap cover within the tank, an exhaust conduit, and a fan assembly. The trap cover comprises a container having an open lower end. The container is configured to fluidly divide air above the water level within the tank into an interior chamber within the container and an exterior chamber outside of the container. The container has a separator extending downward from a ceiling of the container. The separator fluidly divides an upper portion of the interior chamber into a main chamber and an exhaust compartment. The container is configured to pivot with respect to the tank. The container has a first position in which a lower edge of the separator extends to a level below the water level in the main chamber so that air cannot flow from the main chamber to the exhaust compartment. The container also has a second position in which the lower edge of the separator extends to a level above the water level in the interior chamber so that air can flow from the main chamber to the exhaust compartment. The exhaust conduit has an inlet port in the exhaust compartment and an outlet port configured to fluidly communicate with the sewer line. The fan assembly includes a fan configured to draw air from the bowl into the main chamber. The container is in the first position when the fan is not activated, and is in the second position when the fan is activated.

In yet another aspect, the present invention provides a toilet comprising a bowl, a seat, and a sensor controlling operating conditions of the toilet, such as the water level in the tank or the removal of odors from the bowl. In one embodiment, the sensor comprises a photosensor embedded within the seat and configured to sense whether a person is sitting on the seat by sensing the amount of light exposed to the photosensor. In another embodiment, the sensor comprises an odor detector, such as a chip, configured to detect odors of human waste.

In yet another aspect, the present invention provides a toilet configured to (1) conserve water by allowing a user to control the water volume in the tank and (2) remove unpleasant odors from the toilet area by causing gases from the toilet bowl to flow into a sewer line. In this aspect, the toilet comprises a bowl, a tank, an inlet valve, and a fan assembly including a fan. The tank includes an inlet configured to be connected to a water supply. The inlet valve is configured to control the flow of water into the tank from the water supply. The fan assembly is configured to draw air from the bowl to a sewer line when the fan is activated. The inlet valve is configured to be controlled by a user so that the volume of water within the tank can be selectively varied between different stabilized volumes of water.

In yet another aspect, the present invention provides a toilet comprising a float valve, an air conduit, a fan, and a venturi tube. The float valve has an open position in which the float valve permits water from the water supply to enter the tank, and a closed position in which the float valve substantially prevents water from entering the tank. The float valve comprises a float defining upper and side walls of a cavity. The float valve is open when the float is below a float valve activation level, and is closed when the float is at or above the float valve activation level. The fan is configured to generate airflow in the air conduit. The venturi tube has a first end connected to a side wall of the air conduit, and a second end within the cavity of the float. The first end of the venturi tube is in fluid communication with the air conduit. When the water level in the tank is at the float valve activation level, activation of the fan causes airflow within the air conduit. The airflow causes the air pressure in the cavity of the float to decrease due to a venturi effect caused by the venturi tube. The decrease in air pressure causes the float to descend, which in turn causes the float valve to open to permit water to enter the tank from the water supply.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
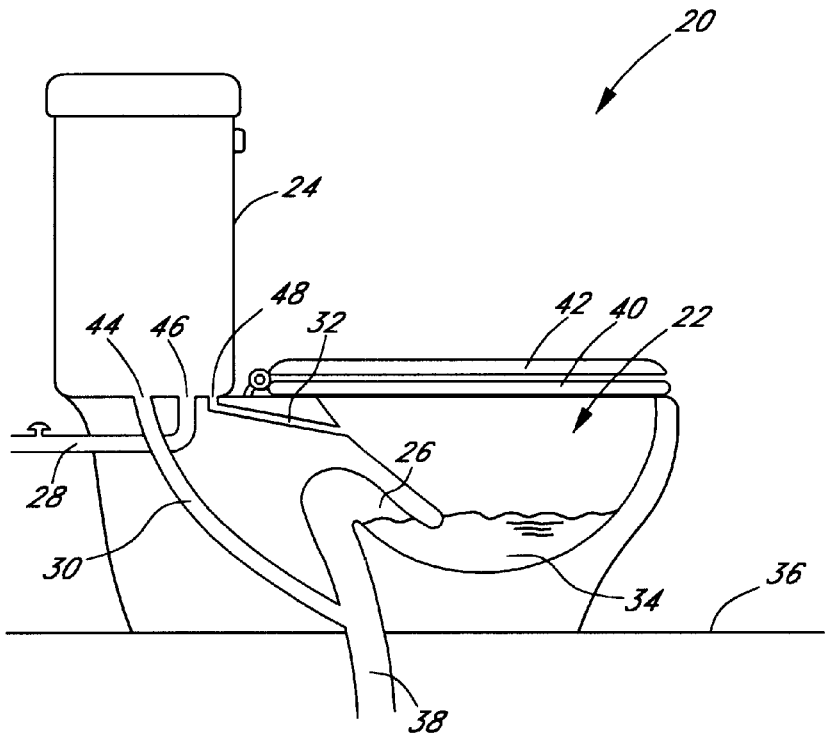
FIG. 1 is a schematic illustration of a toilet of the present invention.

FIG. 1 shows one embodiment of a toilet having features in accordance with the teachings of the present invention. The toilet 20 is secured to a support surface 36 and includes a bowl 22 and a tank 24. The bowl 22 is configured to contain water 34. The bowl 22 is in fluid communication with a water trap 26, which is connected to a sewer line 38 that extends below the ground surface 36 to a sewer. The water trap 26 prevents unpleasant and perhaps noxious sewer gases from seeping up through the sewer line 38 into the bowl 22. The tank 24 includes three fluid ports 44, 46, and 48. The fluid port 44 communicates with an exhaust conduit 30 that extends into the sewer line 38. Preferably, the lower end of the exhaust conduit 30 is positioned as low as possible, to minimize the risk of any possible interference with the siphoning action of water through the water trap 26 when the toilet 20 is flushed. The fluid port 46 communicates with a water supply line 28 connected to a water supply. The fluid port 48 communicates with a flush conduit 32. The conduit 32 allows water to flow from the tank 24 into the toilet bowl 22 to flush the bowl. A toilet seat 40 and a lid or cover 42 are hingedly attached to the bowl 22. The contents of the tank 24 are not shown in FIG. 1.

Figure 2:
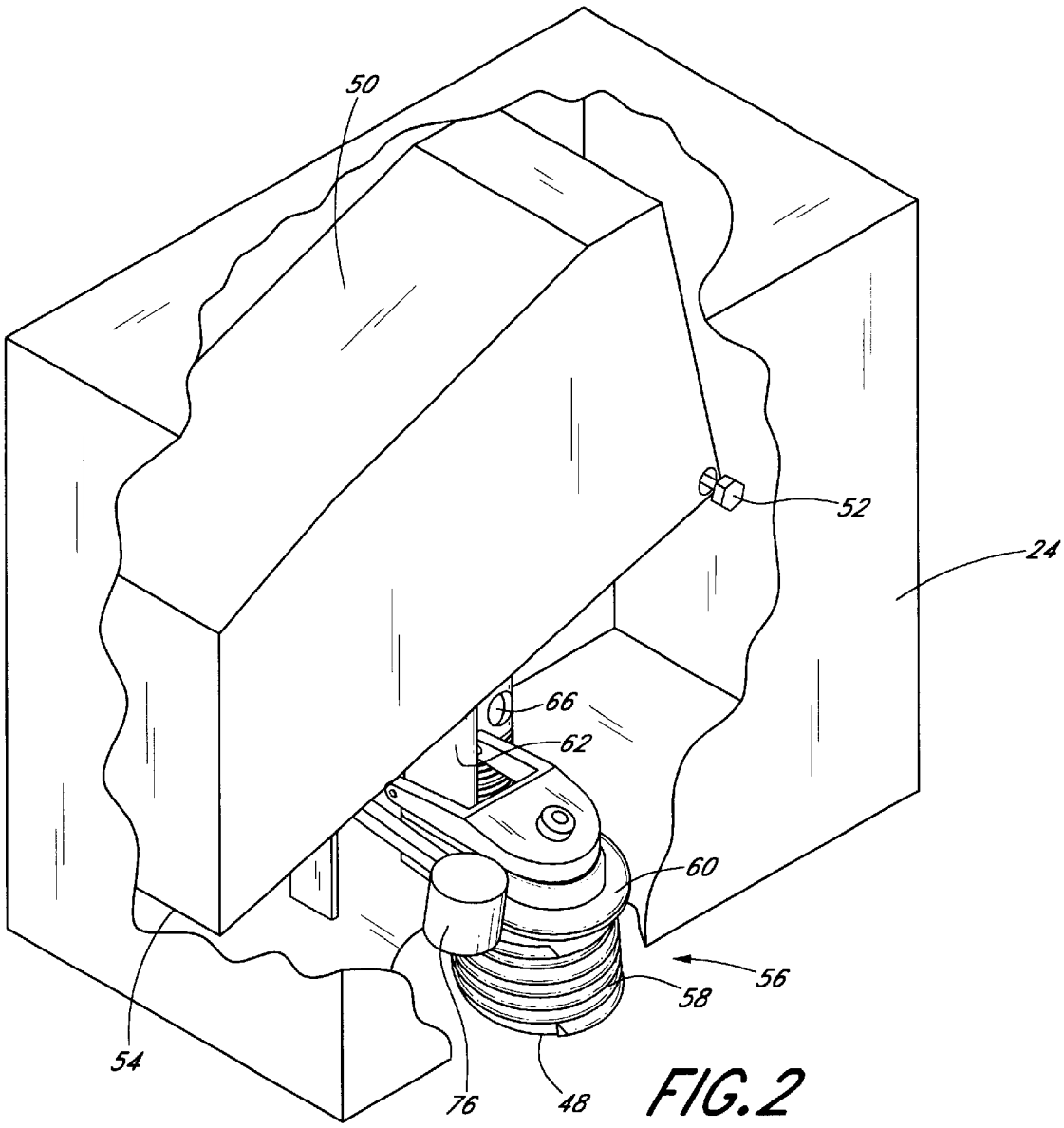
FIG. 2 is a perspective partial cut-away view of the tank of the toilet of FIG. 1.
Figure 3:
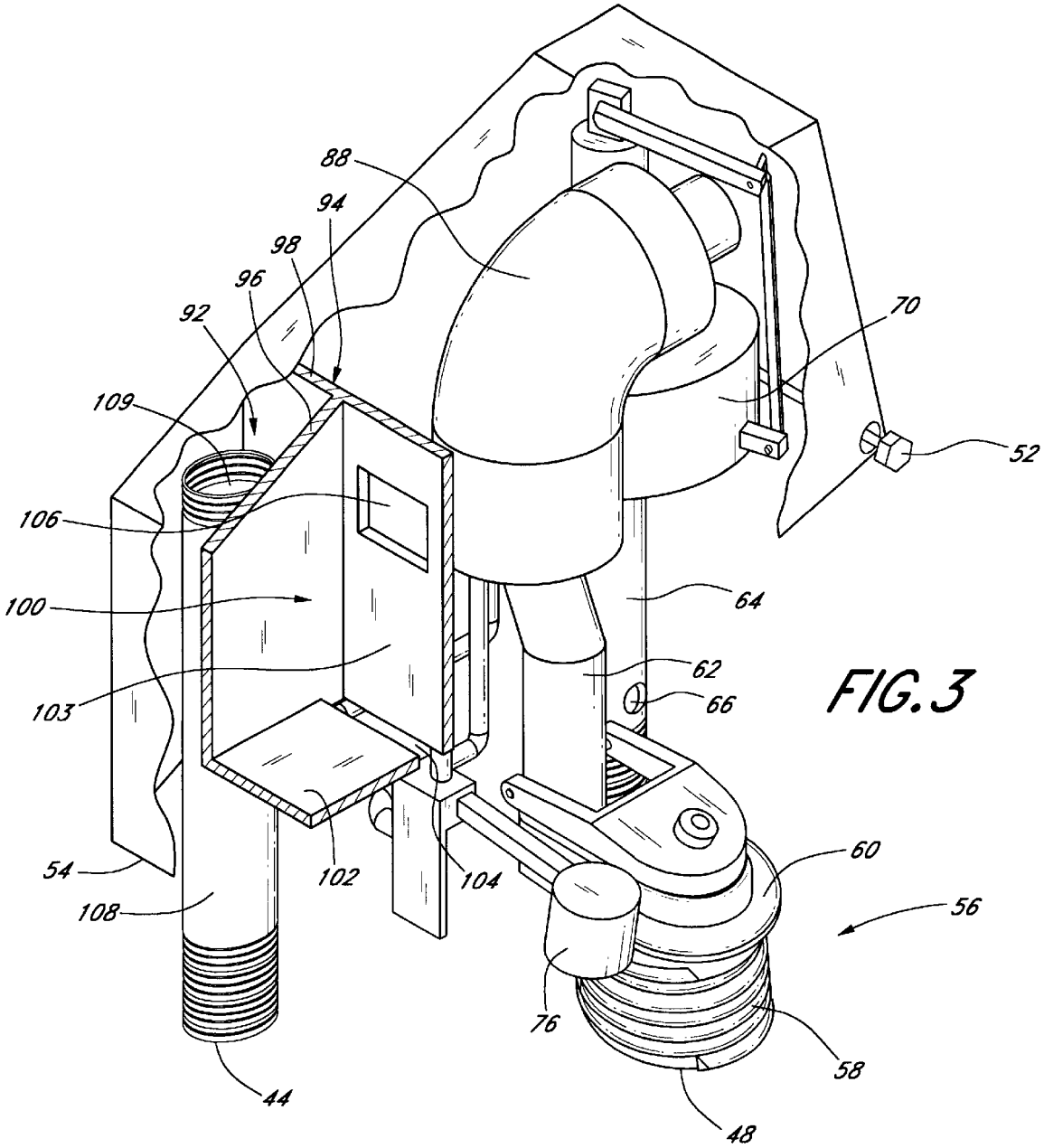
FIG. 3 is a perspective partial cut-away view of the trap cover of the tank of FIG. 2.
Figure 4:
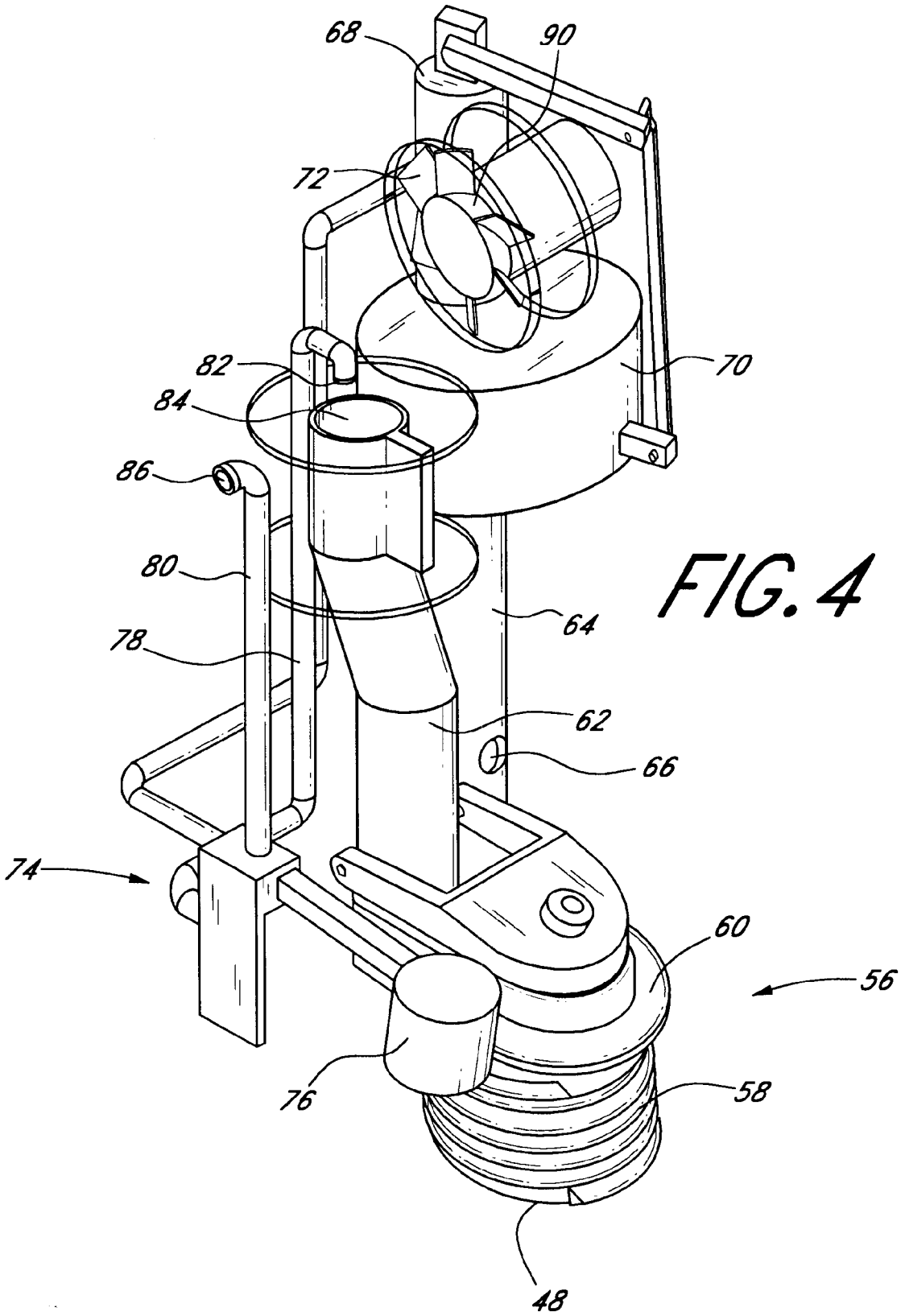
FIG. 4 is perspective view of an interior assembly of the tank of FIG. 2, with the pipe 88 removed for clarity.

FIGS. 2 and 3 illustrate a preferred embodiment of the interior components of the tank 24 of the toilet 20. A trap cover 50 is provided, which comprises a container having an open lower end. The trap cover 50 is preferably hingedly or pivotally secured to the tank 24. In the illustrated embodiment, a bolt 52 pivotally secures a lower comer of the trap cover 50 to an interior surface of the tank 24, such that the end 54 of the cover 50 can move up and down. The trap cover 50 encloses an upper portion of the interior assembly of the tank 24. The trap cover 50 defines an interior or main chamber 51 and an exhaust compartment 92, as defined below.

A flapper valve 56 comprises a tube 58 having a lower opening 48, as described in FIG. 1, and a lid 60. In particular, the tube 58 fluidly communicates with the flush conduit 32. The lid 60 is pivotally secured to an exterior surface of an air intake conduit 62. The flapper valve 56 has a closed position, shown in FIGS. 2 and 3, in which the lid 60 rests upon the upper end of the tube 58. When the flapper valve 56 is closed, water within the tank 24 is prevented from flowing into the toilet bowl 22 (FIG. 1). The flapper valve 56 also has an open position in which the lid 60 is pivoted upward away from the upper end of the tube 58, allowing water within the tank 24 to flow through the tube 58 into the toilet bowl 22 for a flush. Preferably, a user-operated flush control is provided on the exterior of the tank 24, which controls the position of the lid 60. Any of a variety of mechanisms can be used to control the flapper valve, such as a flush arm and chain assembly, as known by those skilled in the art. Regardless of whether the lid 60 is in the open or closed position, the tube 58 is in fluid communication with the lower end of the air intake conduit 62.

As used herein, the term "conduit" may refer to, for example, a tube, pipe, or other channel. A "conduit" can be rigid or flexible, and can be formed of plastic, metal, composites, or other materials.

The water supply line 28 (FIG. 1) is connected to the bottom end of a tank fill conduit 64. The tank fill conduit 64 includes a tank fill vent 66 near the bottom of the tank 24. The tank fill conduit 64 is connected at its upper end to the upper end of a conduit 72. The upper end of the tank fill conduit 64 is also connected to a float valve 68 communicating with a float 70. The float valve 68 has an open position in which water can flow from the conduit 64 into the conduit 72, and a closed position in which water is prevented from doing so. The float valve 68 is configured to open when the float 70 is below a particular float valve activation level and to close when the float 70 is above said level. Since the float remains at the water level in the tank 24, the float valve opens when the water level is below the float valve activation level and closes when the water level is above said level.

The float valve 68 also controls flow through the tank fill vent 66. When the float valve 68 is open, water from the water supply line 28 can freely flow through the vent 66 into the tank 24. When the float valve 68 is closed, flow through the vent 66 is prevented.

The lower end of the conduit 72 is connected to a diverter valve 74 actuated by a float 76. In the illustrated embodiment, the diverter valve 74 comprises a float-arm assembly. When the float 76 is lowered, as shown in FIGS. 2–3, the diverter valve 74 occupies a first position in which the conduit 72 fluidly communicates with a bowl trap fill conduit 78. The conduit 78 has an upper opening 82 positioned over an upper opening 84 of the air intake conduit 62, so that water in the conduit 78 is free to flow into the conduit 62 and then through the tube 58 into the toilet bowl 22. When the float 76 is raised, the diverter valve 74 occupies a second position in which the conduit 72 fluidly communicates with a dampening chamber fill conduit 80. The conduit 80 has an upper opening 86 positioned over a dampening chamber 100 of the trap cover 50 (FIGS. 2, 3), so that water in the conduit 80 can flow into the chamber 100.

In the illustrated embodiment, the lower end of a pipe 88 encloses the upper portions of the air intake conduit 62 and the bowl trap fill conduit 78. The upper end of the pipe 88 encloses a fan 90. Preferably, the fan 90 is configured to draw air from the bowl 22 to the interior of the trap cover 50.

The trap cover 50 preferably includes an exhaust compartment 92 that is fluidly separated from the upper portion of the interior chamber 51 of the trap cover 50. At its lower end, the exhaust compartment 92 is open. In the illustrated embodiment, the compartment 92 comprises the enclosed space between the outer vertical walls of the trap cover 50 and an interior separator 94. In particular, the separator 94 separates the compartment 92 from the interior or main chamber 51 of the trap cover 50. In the illustrated embodiment, the separator 94 comprises generally vertical and orthogonal wall portions 96 and 98. Of course, the separator 94 could have various other configurations, giving due consideration to the goal of defining an exhaust compartment with an open end and fluidly separating the exhaust compartment from the remainder of the interior of the trap cover 50, i.e., the main chamber 51. Although, in the illustrated embodiment, the exhaust compartment 92 has a rectangular horizontal cross-section, those of skill in the art will readily appreciate from the teachings herein that the exhaust compartment can have any horizontal cross-sectional shape, such as, for example, circular. A tank exhaust conduit 108 has an open upper end 109 extending into the exhaust compartment 92, and a lower end in fluid communication with the exhaust conduit 30 (FIG. 1).

The trap cover 50 preferably also includes a dampening chamber 100. In the illustrated embodiment, the dampening chamber comprises the space enclosed by the outer walls of the trap cover 50, the wall portion 96, a generally vertical wall 103, and a generally horizontal floor 102. The floor 102 has a flow port 104 therein. In the illustrated embodiment, the flow port 104 comprises a slot in the floor 102 along the vertical wall 103. The wall 103 has an opening or window 106 configured to receive water from the upper end 86 of the dampening chamber fill conduit 80.

Figure 5:
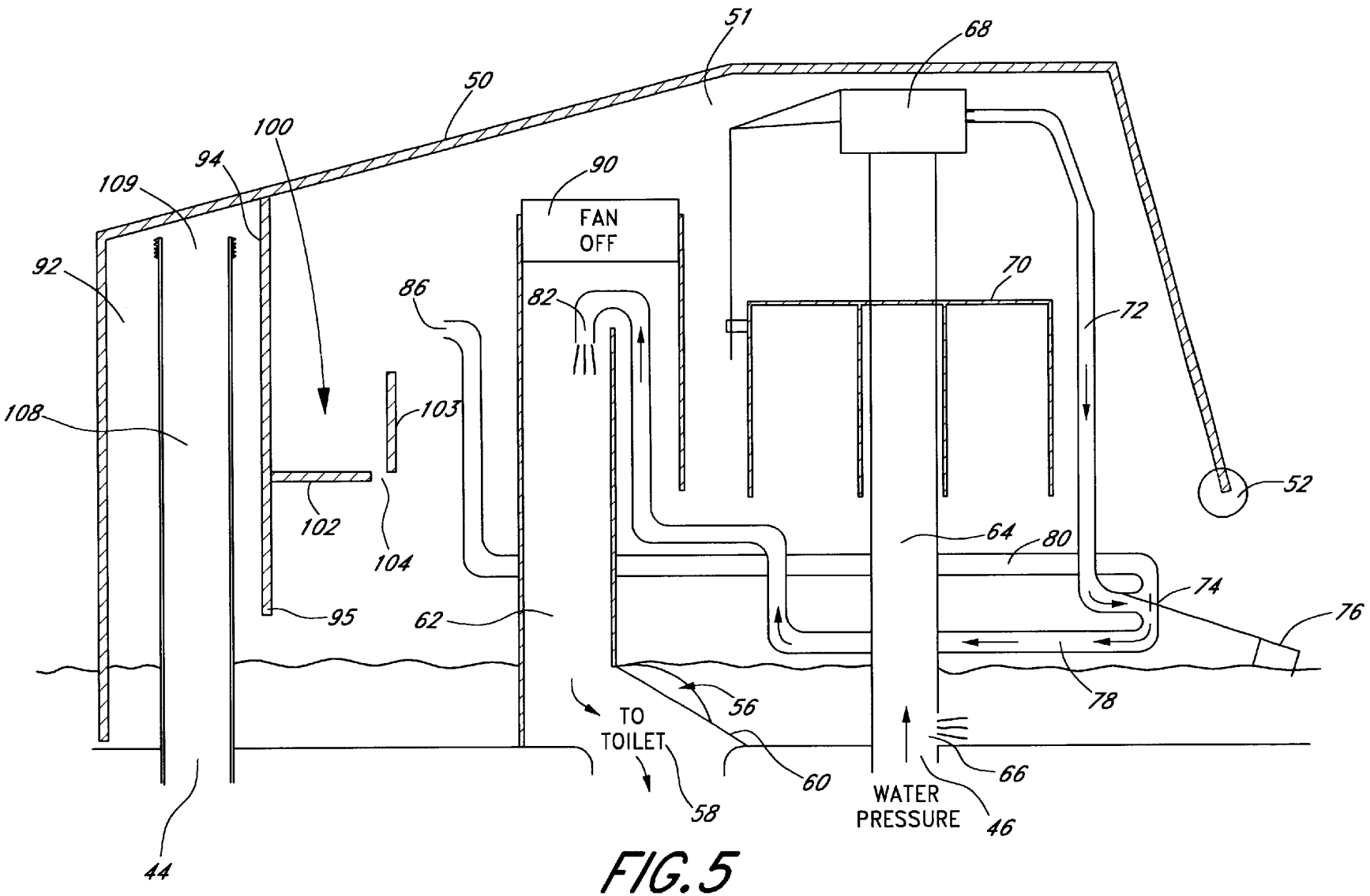
FIG. 5 is a schematic view of the tank assembly of the toilet of FIG. 1, showing a moment of a tank filling process during which water flows into the toilet bowl.

FIGS. 5–13 illustrate the operation of the toilet of the present invention. With reference to FIG. 5, when the tank 24 is empty, water is supplied under pressure from the water supply line 28 (FIG. 1) to the tank fill conduit 64. At this point, the float 70 is lower than the float valve activation level, causing the float valve 68 to occupy its open position. This allows water from the water supply to flow through the tank fill conduit 64, through the float valve 68, and then through the tank fill vent 66 to begin filling the tank 24. Water also flows through the float valve 68 into the conduit 72 to the diverter valve 74. When the tank 24 initially begins filling, the float 76 is lowered, causing the diverter valve 74 to occupy its first position. Thus, the water in the conduit 72 flows into the bowl trap fill conduit 78 and discharges through the upper opening 82 thereof. This water flows through the air intake conduit 62 and the tube 58 into the toilet bowl 22, to fill the trap 26.

Figure 6:
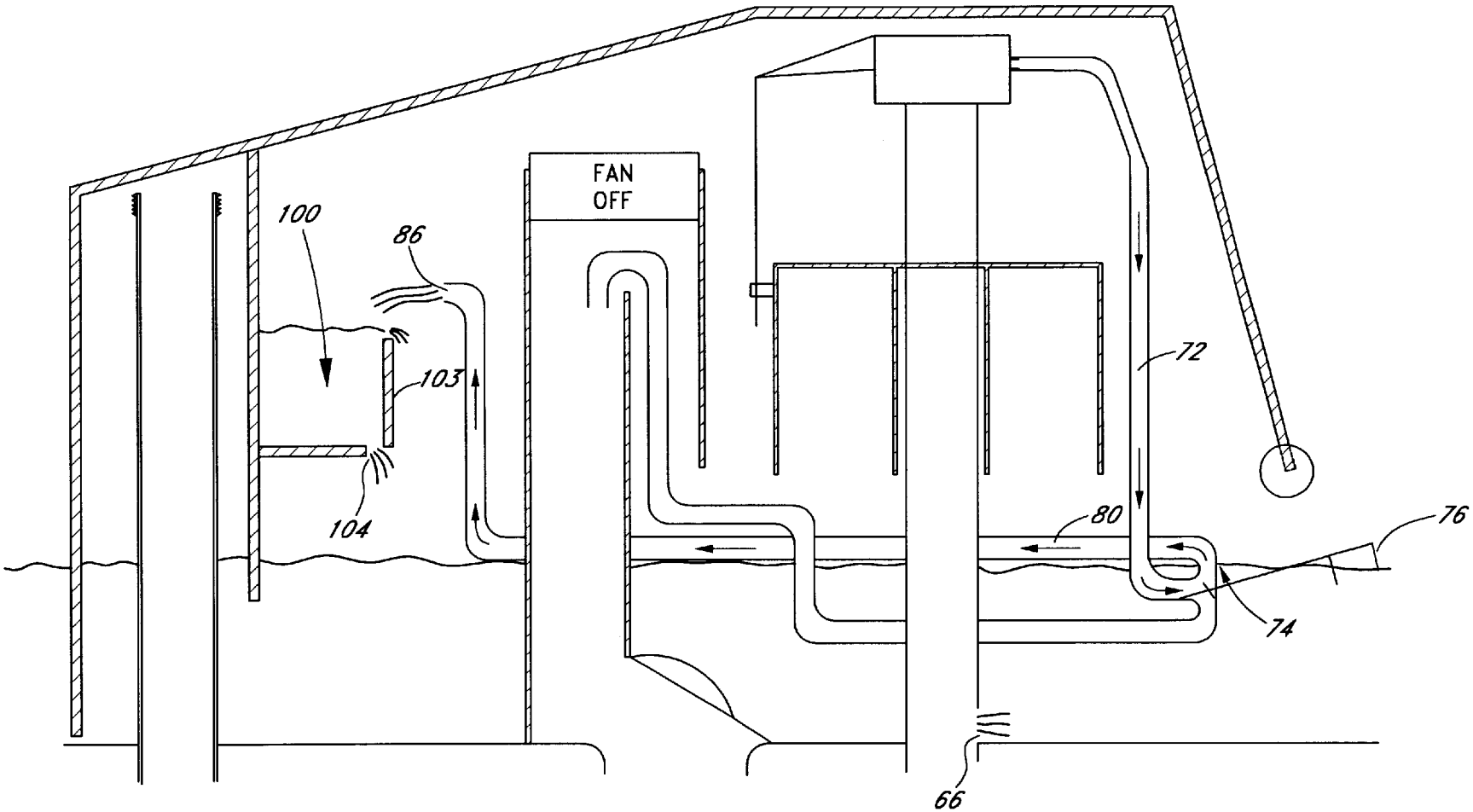
FIG. 6 is a schematic view of the tank assembly of the toilet of FIG. 1, showing a moment of a tank filling process at which water flows into the dampening chamber of the trap cover.

With reference to FIG. 6, the water from the water supply continues to fill the tank 24 via the tank fill vent 66 until the float 76 of the diverter valve 74 raises to its second position. This causes the water flowing through the conduit 72 to flow into the dampening chamber fill conduit 80. The water in the conduit 80 discharges through the upper opening 86 thereof, into the dampening chamber 100. As water flows into the dampening chamber 100, some of the water drains out through the flow port 104. Preferably, the conduit 80 and the flow port 104 are sized and configured so that the dampening chamber 100 fills with water from the conduit 80 at a faster rate than the water drains out through the flow port 104. Eventually, the water begins to overflow out of the dampening chamber 100 by flowing through the opening 106 in the wall 103 (FIGS. 3, 3A, 3B).

Figure 7:
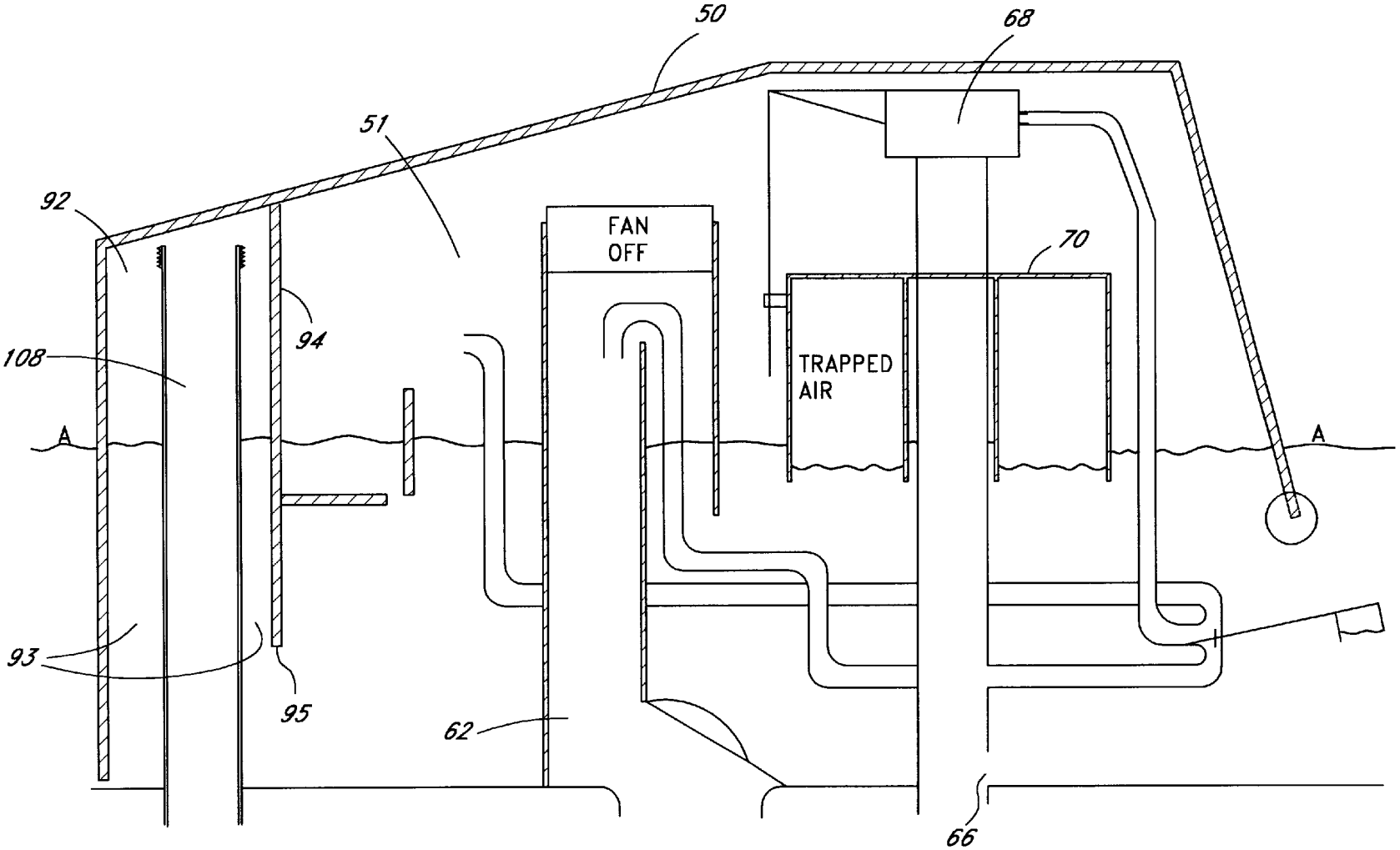
FIG. 7 is a schematic view of the tank assembly of the toilet of FIG. 1, showing a stabilized low water volume condition of the tank.

With reference to FIG. 7, the water level in the tank 24 eventually rises to the float valve activation level A associated with the float 70, causing the float valve 68 to close. When the float valve 68 closes, water is prevented from flowing through the tank fill vent 66. Thus, the tank 24 stops receiving water from the water supply. Water level A corresponds to a low water level or volume of the tank 24. Flushing of the toilet while in this condition will consume a relatively lower volume of water. The low water volume of the tank 24 depends upon the physical dimensions of the tank, and can be any desired volume. Preferably, the low water volume of the tank 24 is within the range of 0.25–1.6 gallons or higher. The low water volume of the tank is preferably at most 1.5 gallons, even more preferably at most 1.4 gallons, even more preferably at most 1.3 gallons, even more preferably at most 1.25 gallons, even more preferably at most 1 gallon, even more preferably at most 0.75 gallons, even more preferably at most 0.5 gallons, and even more preferably at most 0.25 gallons.

In the stabilized low water volume condition of FIG. 7, the water level in the chamber 51 is higher than the lower end 95 of the separator 94 of the trap cover 50. This produces a water seal or trap 93 between the chamber 51 and the exhaust compartment 92. The water trap 93 prevents noxious and unpleasant sewer gases from entering the toilet bowl 22 via the path provided by the exhaust conduit 108, the chamber 51, and the air intake conduit 62. The UPC generally requires that the vertical depth of a water trap must exceed a minimum amount, such as, for example, 2.0 inches. In FIG. 7, the depth of the water trap 93, i.e., the vertical distance between the water level in the exhaust compartment 92 and the lower end 95 of the separator 94, is preferably greater than or equal to the minimum required depth of a water seal, as prescribed by the UPC. Those of ordinary skill in the art will readily appreciate from the teachings herein that the length of the separator 94 can be adjusted to vary the depth of the water trap 93. The depth of the water trap 93 is preferably at least 1.0 inches, more preferably at least 1.5 inches, even more preferably at least 2.0 inches, even more preferably at least 2.5 inches, and even more preferably at least 3.0 inches.

In general, the UPC requires that toilets use not more than a certain amount of water per flush, such as 1.6 gallons. Thus, most toilets are configured to consume the required volume of water per flush. However, people often flush items other than human waste down the toilet, such as tissue papers and other items. Often, when such items are flushed, it would be wasteful to consume the entire volume of water that the UPC prescribes as a maximum flush volume. Advantageously, the toilet 20 of the invention is configured to contain less water than a typical toilet tank, in order to minimize the water consumption associated with flushing smaller items down the toilet. If the toilet 20 were flushed while the water level in the tank 24 is at level A, the water consumption is held to a minimum. As described below, the toilet 20 is configured to flush a larger volume of water, as may be required by the UPC, when the user flushes the toilet after sitting on the toilet seat 40.

The tank 24 and the pipe 88 (FIG. 3) are preferably configured so that when the tank 24 is in its low water volume condition, as shown in FIG. 7, the water level in the chamber 51 of the trap cover 50 is above the lower end of the pipe 88. As a result, a water seal is formed to prevent airflow from the chamber 51 into the pipe 88 through the lower end of the pipe 88. This ensures that when the fan 90 is activated, as discussed below, the fan draws air from the toilet bowl 22 (FIG. 1) through the air intake conduit 62, through the pipe 88 and into the chamber 51. In contrast, if the water level in the chamber 51 were below the lower end of the pipe 88, activation of the fan 90 would merely cause air to circulate from the chamber 51 through the bottom of the pipe 88, up through the pipe, through the fan 90, and back into the chamber 51. In such a configuration, the fan 90 would not draw air from the toilet bowl 22.

Figure 14:
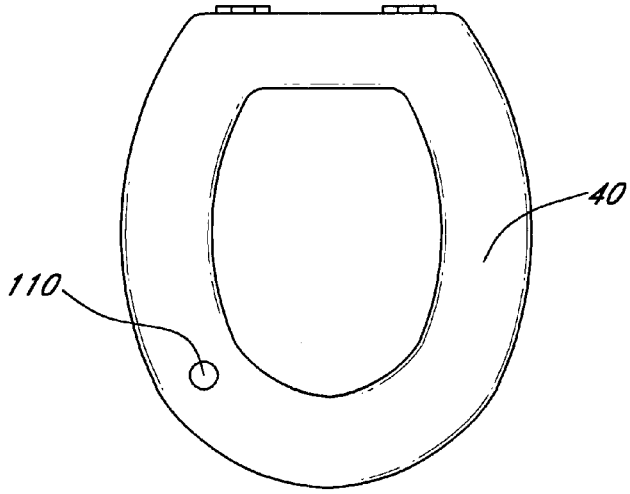
FIG. 14 is a perspective view of a sensor integrated within a toilet seat of the toilet of FIG. 1.

With reference to FIG. 14, the toilet seat 40 preferably includes a sensor 110 configured to sense whether a person is sitting on the seat. Preferably, the sensor 110 activates the fan 90 (FIG. 5) when a person sits on the seat 40. In one embodiment, the sensor 110 comprises a photosensor or photocell embedded within the upper surface of the seat 40. The photocell is configured to sense light. In one embodiment, the photocell is configured to activate the fan 90 when no light is sensed. In this embodiment, the sensor activates the fan 90 when a person sits on the toilet seat 40 and thus covers the photocell to prevent light from shining thereon. Advantageously, an embedded photocell is less susceptible to wear and tear and, thus, lasts longer than other types of sensors.

In another embodiment, an odor detector, such as a chip, is placed in a position such that the odor detector can readily detect odors of natural human waste. The control system of the toilet can be configured so that the odor detector activates the fan 90 when human waste odors are detected. One odor-detecting chip that is believed to be usable or modifiable for the purposes of the present invention is the "Nose Chip," manufactured and sold by Cyrano Science of California. Those of ordinary skill in the art will readily understand from the teachings herein that various other types of sensors can be used, such as, for example, weight-activated sensors.

Figure 8:
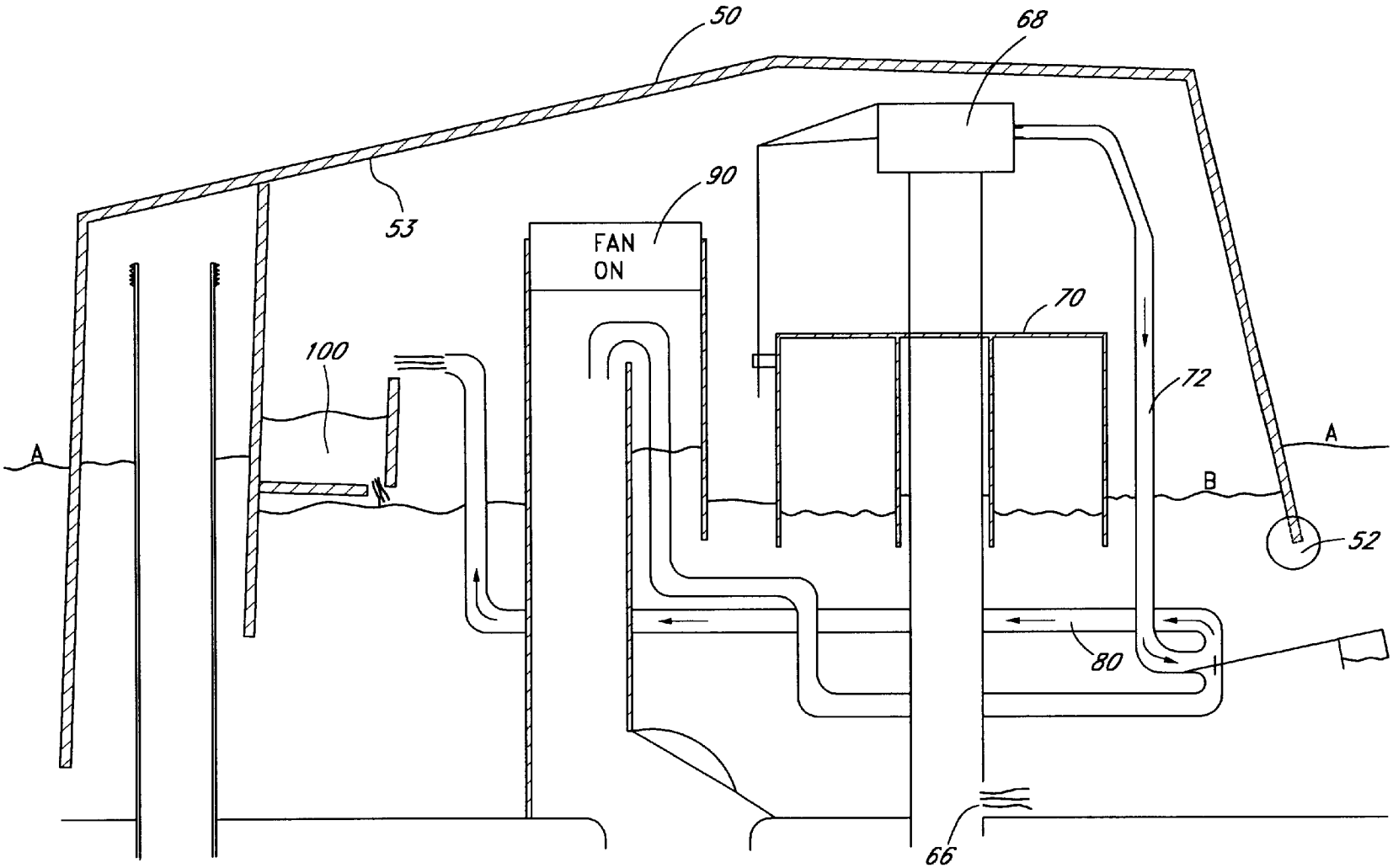
FIG. 8 is a schematic view of the tank assembly of the toilet of FIG. 1, showing the condition of the tank when the fan is initially activated.

FIG. 8 shows the tank 24 immediately after a person sits on the seat 40 (FIG. 1). The activated fan 90 draws air from the toilet bowl 22 into the interior chamber 51 of the trap cover 50. This causes the air pressure in the chamber 51 to increase. The increasing air pressure exerts an upward air pressure force on the upper interior surface 53 of the trap cover 50, tending to cause the trap cover 50 to pivot upward about the bolt 52. However, the weight of the water in the dampening chamber 100 slows the upward pivoting motion of the trap cover 50. The increased air pressure also exerts a downward force on the water in the chamber 51, causing the water level therein to decrease from level A to level B. The decrease in water level causes the float 70 to descend, thus opening the float valve 68. Water is thereafter supplied to the tank 24 from the tank fill vent 66. Water also flows through the float valve 68, the conduit 72, and the conduit 80 into the dampening chamber 100.

Figure 9:
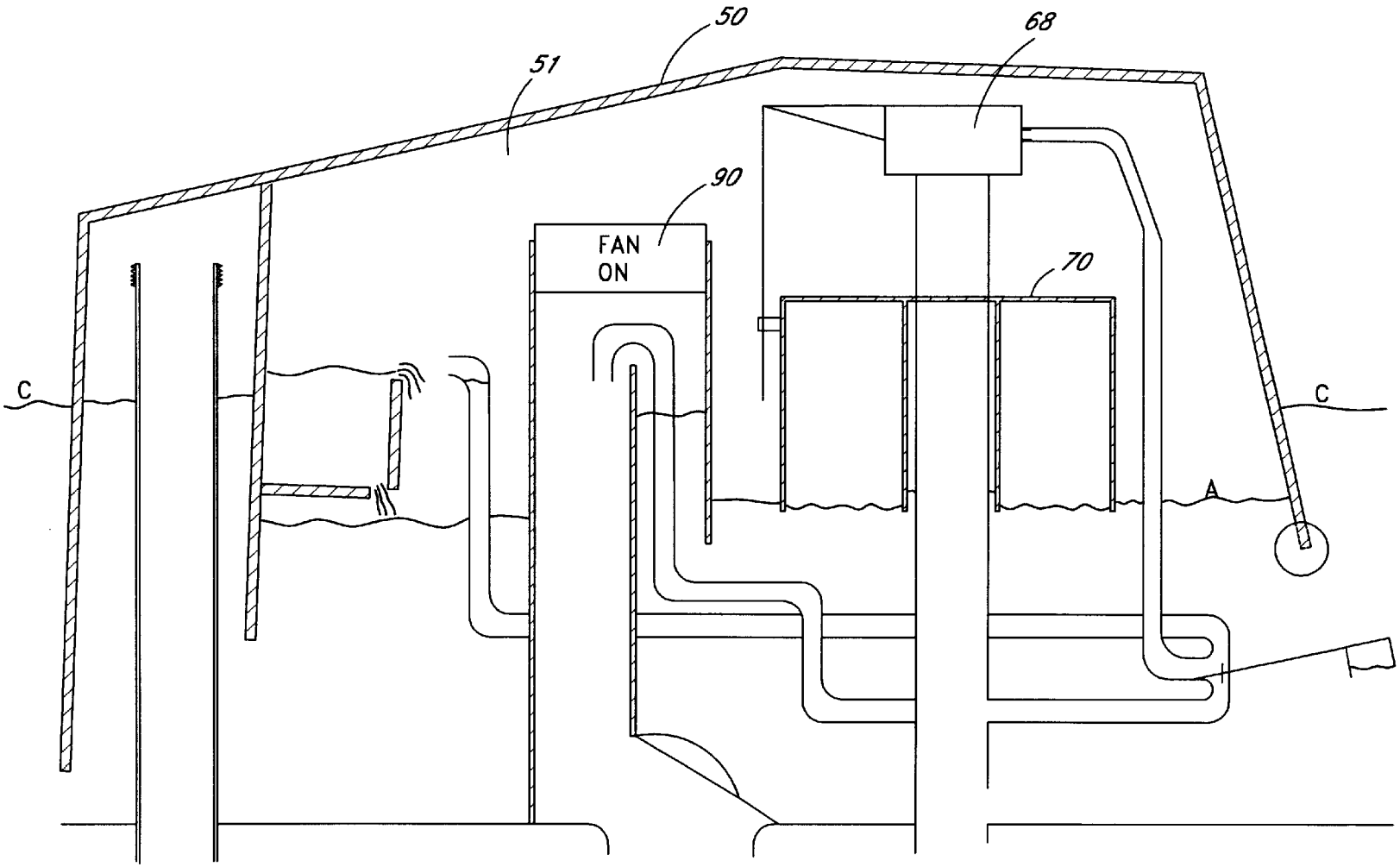
FIG. 9 is a schematic view of the tank assembly of the toilet of FIG. 1, showing a high water volume condition of the tank.

With reference to FIG. 9, the water level continues to rise until the water level in chamber 51 reaches the shut-off level associated with the float 70 and the float valve 68. Due to the continued operation of the fan 90, the air pressure in the chamber 51 is higher than that in the remainder of the tank 24, resulting in a water level differential therebetween. Due to the air pressure differential between the chamber 51 and the exterior of the trap cover 50, the water level C in the remainder of the tank 24, i.e., outside of the trap cover 50, is higher than the water level in the chamber 51. This condition corresponds to a high water level or volume of the tank 24. Flushing of the toilet while in this condition will consume a relatively higher volume of water. The high water volume is preferably at least 1.0 gallons, more preferably at least 1.3 gallons, even more preferably at least 1.6 gallons, and even more preferably the maximum that the UPC permits.

The differential between the high water volume and the low water volume can be adjusted by varying the interior dimensions of the tank 24. For example the tank can have a flared configuration so that the horizontal cross-section of the tank increases from the bottom of the tank to the top. Such a configuration would require a relatively large additional volume of water to effect an increase in the water level. The differential between the high and low water volumes of the tank 24 can also be adjusted by varying the power supplied to the fan 90, or by varying the dimensions of the dampening chamber 100, the flow port 104, and other dimensions, giving due consideration to the goal of adjusting the weight and the rate of change of the weight of the water in the dampening chamber 100.

Figure 10:
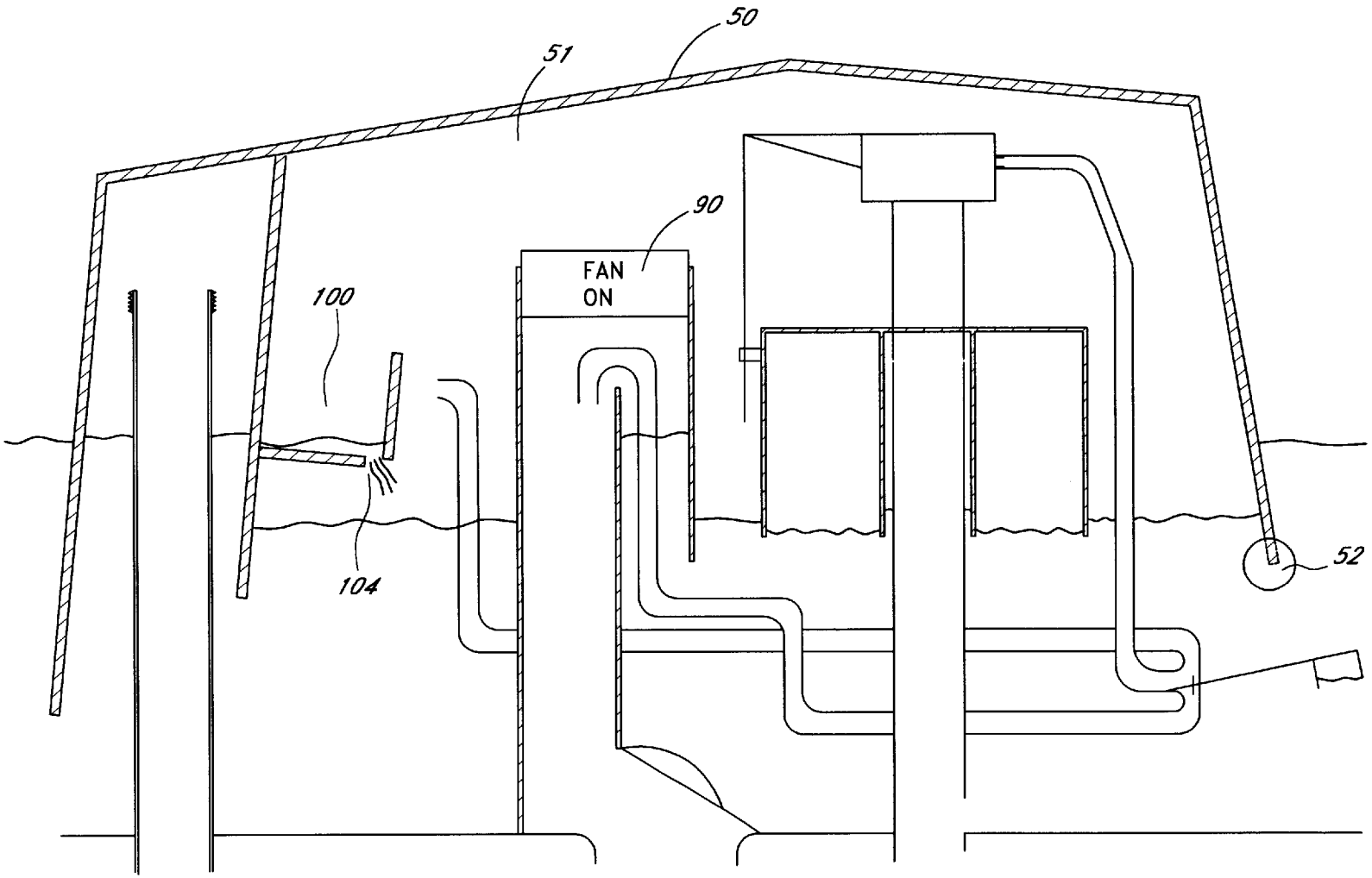
FIG. 10 is a schematic view of the tank assembly of the toilet of FIG. 1, showing the pivoting motion of the trap cover caused by activation of the fan.

With reference to FIG. 10, the operation of the fan 90 causes the air pressure in the chamber 51 to increase above the air pressure in the remainder of the tank 24, i.e., outside of the trap cover 50. This causes the air pressure force acting upward on the upper interior surface 53 of the trap cover 50 to increase. Further, as water drains through the flow port 104, the counter-acting weight of the water in the dampening chamber 100 decreases. The trap cover 50 pivots upward about the bolt 52.

Figure 11:
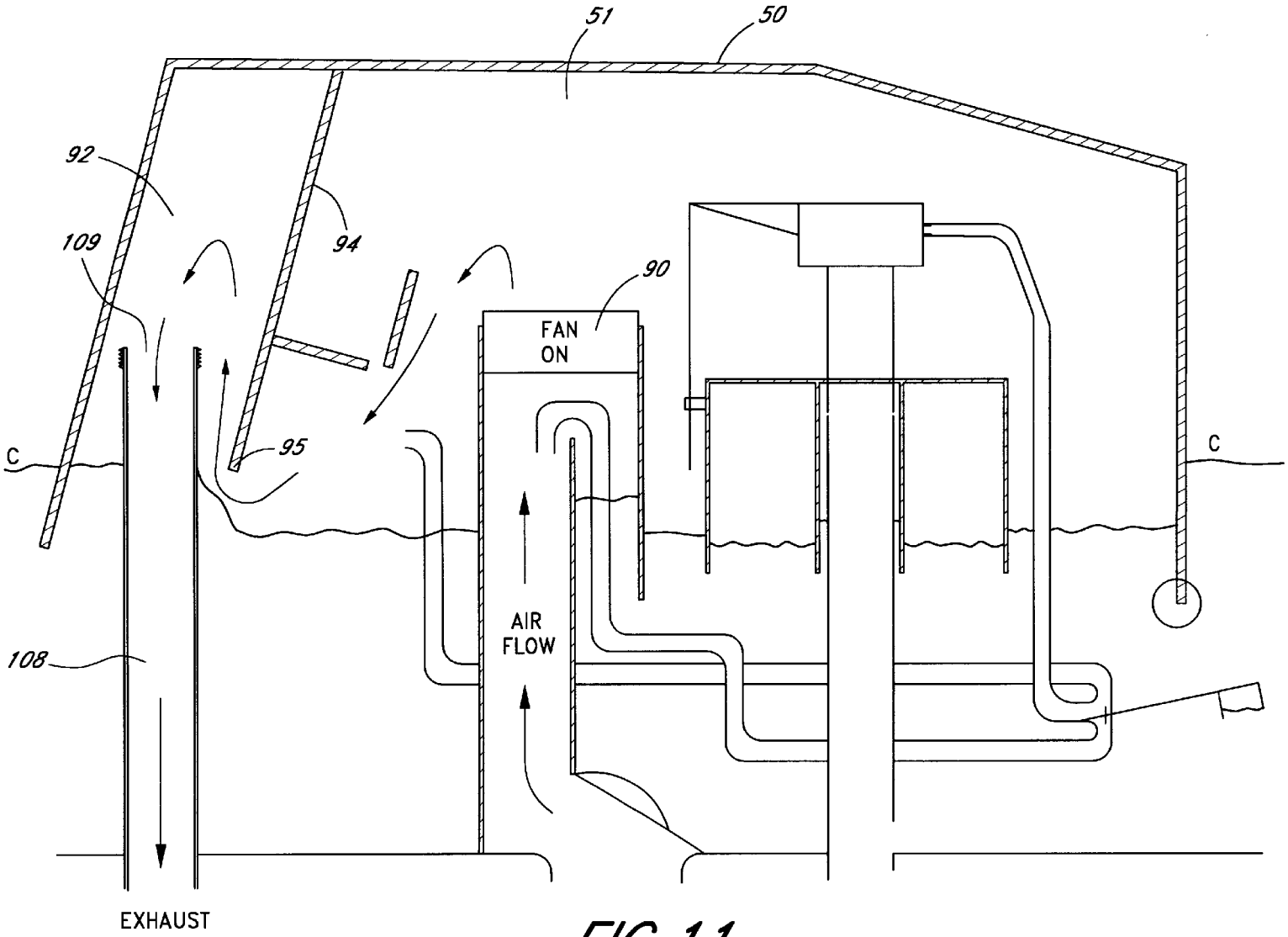
FIG. 11 is a schematic view of the tank assembly of the toilet of FIG. 1, showing the trap cover pivoted upward to allow air flow from the toilet bowl into the exhaust conduit.

With reference to FIG. 11, the trap cover 50 eventually pivots high enough so that the lower end 95 of the interior wall 94 rises above the surface of the water in the chamber 51. This allows the air in the chamber 51 to flow into the exhaust chamber 92, through the upper opening 109 of the tank exhaust conduit 108, and down through the exhaust conduits 108 and 30 (FIG. 1) to the sewer line 38. As long as a person continues sitting on the toilet seat 40, the fan 90 draws air from the bowl 22 into the sewer line 38. Advantageously, obnoxious odors are removed from the toilet bowl. The airflow into the sewer prevents noxious and unpleasant sewer gases from seeping back up into the toilet area.

Note that the water in the dampening chamber 100 slows the upward motion of the trap cover 50 from the position shown in FIG. 7 to that shown in FIG. 11. This permits the air pressure in the chamber 51 to build up and cause the water level therein to decrease. As explained above, the decrease in the water level opens the float valve 68, permitting water to enter the tank 24 via the tank fill vent 66, so as to fill the tank 24 to the high water volume shown in FIG. 11. Without the dampening chamber 100, the trap cover 50 would pivot upward to the position shown in FIG. 11 more quickly, immediately after the fan 90 is activated. In that case, the air pressure in chamber 51 would increase only slightly before the chamber 51 is able to fluidly communicate with the exhaust conduit 108. The air pressure would not build up enough to lower the water volume therein, or would only result in a very small decrease in the water level. Consequently, the float valve 68 would either not open or would open for only a short duration of time, such that the high water volume (FIG. 11) would only be slightly greater than the low water volume (FIG. 7). Thus, the dampening chamber 100 advantageously permits a larger differential between the high water volume and the low water volume.

Those of ordinary skill in the art will readily appreciate from the teachings herein that other methods or dampening mechanisms can be used to slow the upward motion of the trap cover 50. For instance, a hydraulic or partially hydraulic linkage can be provided in connection with the trap cover 50.

Figure 12:
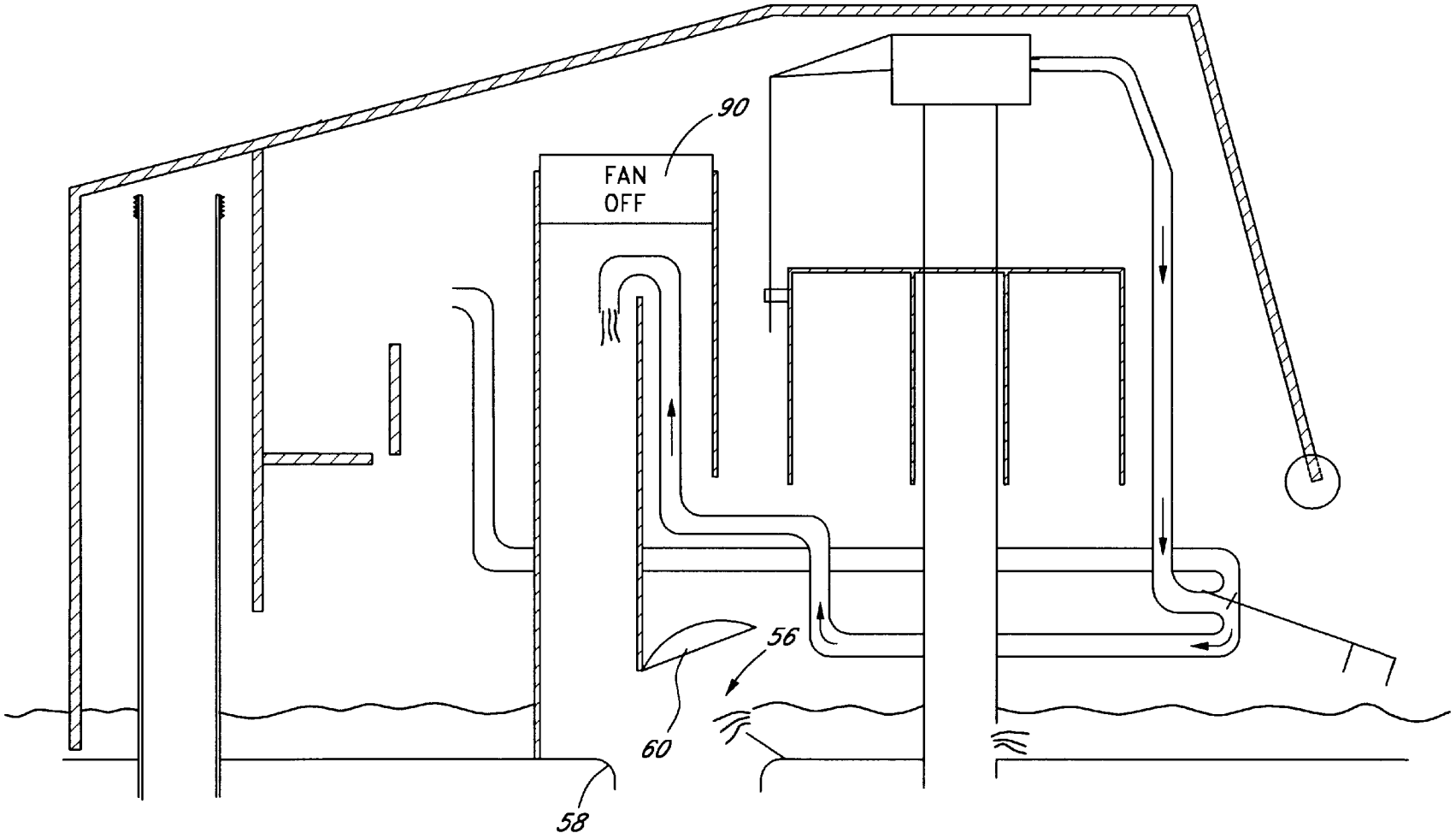
FIG. 12 is a schematic view of the tank assembly of the toilet of FIG. 1, shown after the tank has been flushed.

FIG. 12 shows the toilet 20 (FIG. 1) after a user has operated the exterior flush control to flush the toilet. When the user flushes the toilet 20, the lid 60 of the flapper valve 56 lifts up off of the upper end of the tube 58. In other words, the flapper valve 56 opens. This permits the water in the tank 24 to flow through the tube 58 into the toilet bowl 22 (FIG. 1). The water flows through the trap 26 to the sewer line 38, thereby flushing the contents of the bowl 22 down to the sewer. When the water in the tank 24 is substantially discharged into the bowl 22, the lid 60 pivots back down to cover the upper end of the tube 58. In other words, the flapper valve 56 closes. At this point, the toilet has returned to the condition shown in FIG. 5. Thereafter, the tank 24 fills with water as described above, until it reaches the low water volume condition shown in FIG. 7.

The toilet 20 can be flushed while in the low water volume condition (FIG. 7) or in the high water volume condition (FIG. 11). Flushing of the toilet 20 while in the low water volume condition results in a lower water volume flush and, consequently, relatively less water consumption. Flushing of the toilet 20 while in the high water volume condition results in a higher water volume flush and, consequently, relatively more water consumption. As described above, the tank 24 fills to the high water volume level only when a person sits on the toilet seat 40. Thus, the degree of water consumption is dependent upon whether a person has sat on the toilet seat 40 since the prior flush. Advantageously, the present invention achieves such water conservation without the use of (1) a specialized or dual-function flush control handle, or (2) two separate flush control handles. The toilet 20 can be operated with a single conventional flush control handle.

In one optional aspect of the invention, a timer and a timer operation are provided so that the fan 90 continues to operate after a user gets up from the toilet seat 40. This ensures that the fan 90 will continue to draw air from the toilet bowl 22 for a desired delay period. After the expiration of the delay period, the fan 90 shuts off. Advantageously, the odor-removing assembly continues to remove unpleasant odors that may remain in the area of the bowl 22 for some time after a person gets up from the seat 40.

Figure 13:
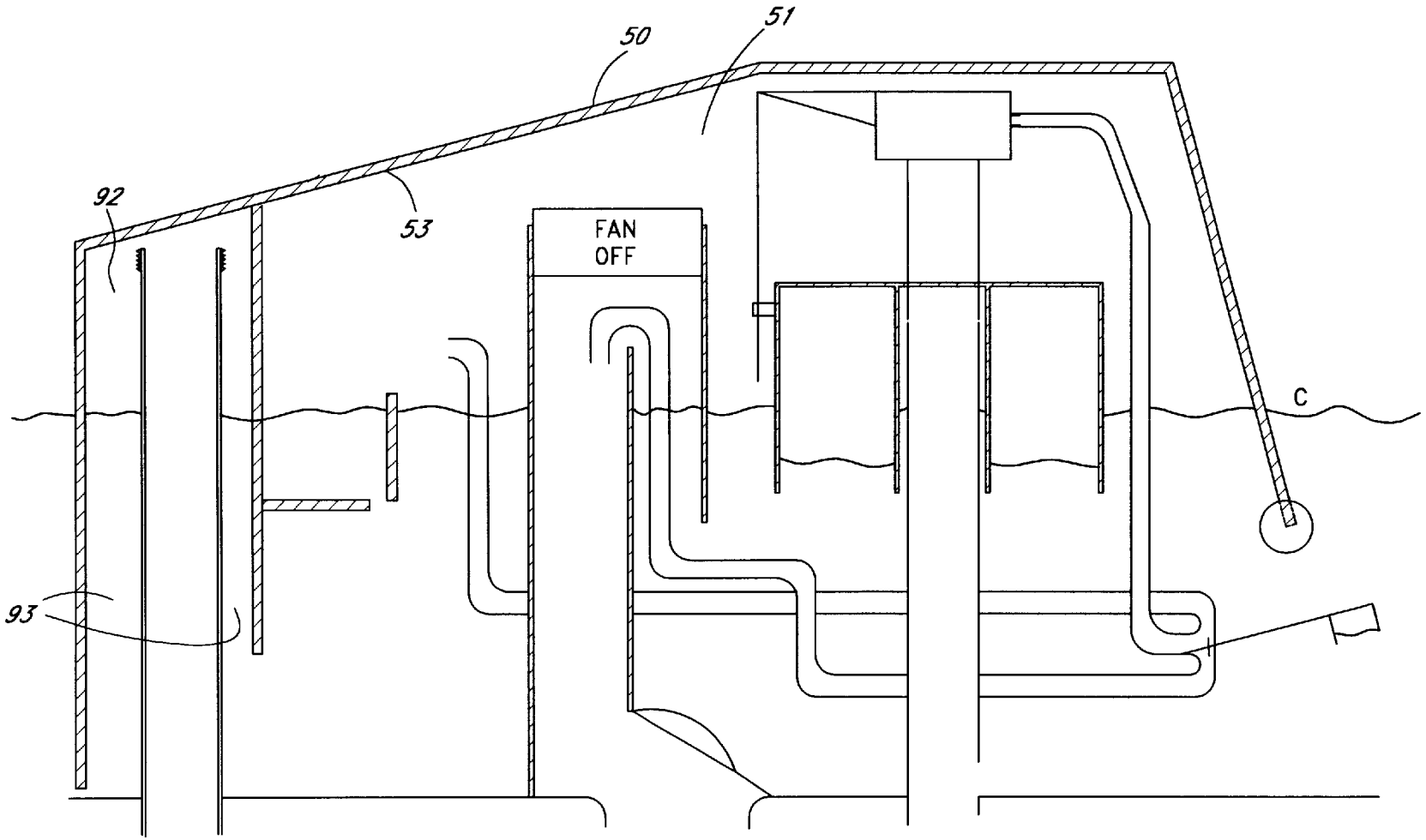
FIG. 13 is a schematic view of the tank assembly of the toilet of FIG. 1, showing a stabilized high water volume condition of the tank, after the fan is deactivated without flushing.

After sitting on the toilet seat 40, a user may get up and leave without flushing the toilet. In this case, the water trap or seal 93 between the interior chamber 51 of the trap cover 50 and the exhaust compartment 92 is advantageously reestablished without any user intervention. After the user gets up, the sensor 110 (FIG. 14), senses that nobody is sitting on the seat 40. This causes the fan 90 to shut off. The fan 90 can shut off immediately after the user gets up or, as described above, after a delay period. With reference to FIG. 13, the deactivation of the fan 90 causes the air pressure in the chamber 51 to decrease, resulting in a consequent decrease in the upward air pressure force acting on the upper interior surface 53 of the trap cover 50. The trap cover 50 pivots back to its initial position without any user intervention. This reestablishes the water trap or seal 93 between the chamber 51 and the exhaust chamber 92. The water traps 93 and 26 (FIG. 1) both prevent noxious and unpleasant sewer gases from seeping back into the toilet bowl. The tank 24 remains in the high water volume level.

Figure 15A:
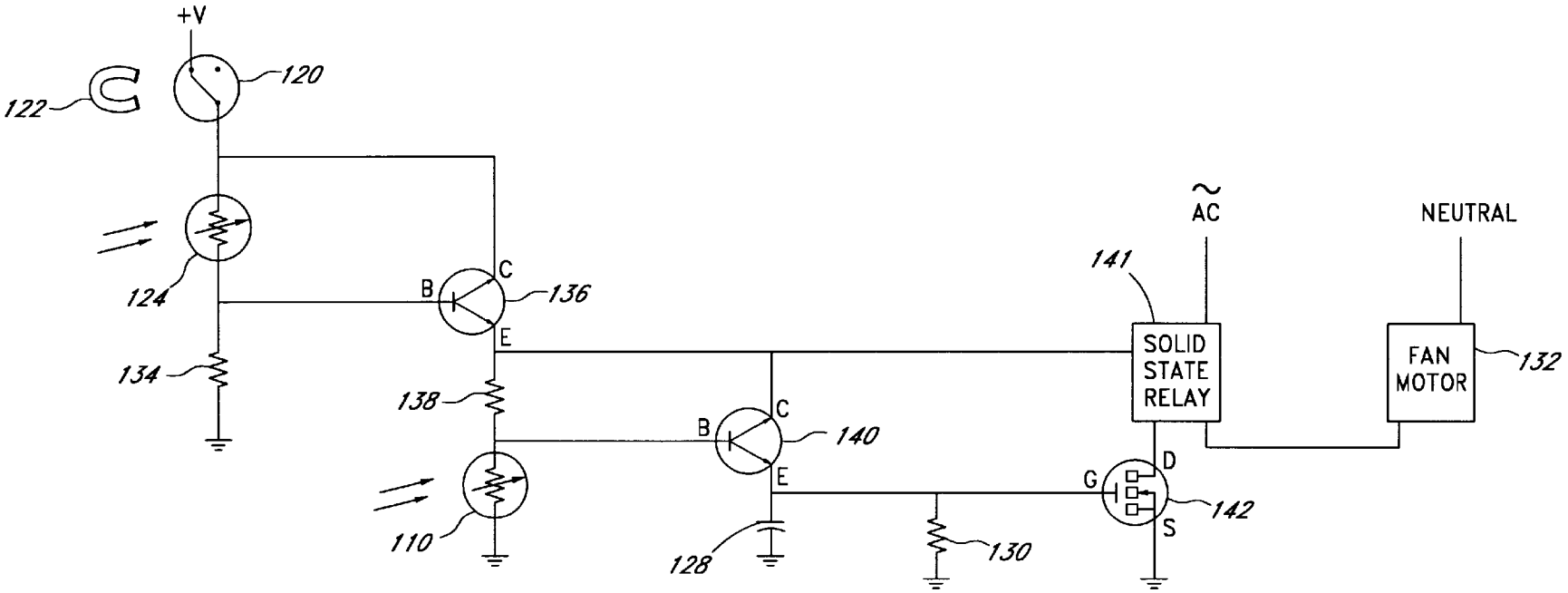
FIG. 15A is a circuit diagram illustrating one embodiment of a control system of the toilet of the invention, utilizing a photosensor.

FIG. 15A is an electric circuit diagram of a simple solid state control circuit that can be utilized in the toilet of the present invention. In one embodiment, a magnetic reed switch 120 is mounted in the front wall of the tank 24 (FIG. 1), and a magnet 122 is mounted on the top surface of the toilet seat cover 42. Preferably, the switch 120 and the magnet 122 are positioned so as to contact one another when the toilet seat cover 42 is brought up to a rested position. Preferably, the control system is armed only when the seat cover is brought up. An ambient light photoresistor 124 or suitable substitute (phototransistor, etc.) can also be mounted on an exterior surface of the tank 24. Preferably, the circuit is armed only when the photoresistor 124 detects ambient light. This prevents unwanted operation of the fan 90 when ambient light is not present, such as at night.

With reference to FIGS. 14 and 15A, the sensor 110, which can be a photoresistor or suitable substitute, can be embedded in the upper surface of the toilet seat 40, preferably in the thigh area. The sensor 110 switches the capacitor discharge delay circuit when no ambient light is present, such as when the sensor 110 is covered by a person's thigh as the person is seated on the seat 40. When ambient light is not detected, the circuit switches on the fan motor 132. A capacitor 128 and a discharge rate resistor 130 provide a shut-off delay after the sensor 110 detects ambient light. The delay ensures that the fan 90 will remain activated if the person shifts about while seated on the seat 40, thus temporarily exposing the sensor 110 to light. The delay also ensures fan operation for some time after the person gets up from the seat, so that lingering unpleasant odors are removed from the toilet area. Additional magnetic reed switches can be incorporated into the circuit as needed (such as a magnet on top of a float configuration) to switch the circuit on or off at desired water levels inside the tank 24.

The following table describes some of the circuit elements shown in the circuit of FIG. 15A, according to one embodiment thereof.

| CIRCUIT ELEMENT | DESCRIPTION |
|---|---|
| 128 | 2.2 $\mu$F |
| 130 | 20 M$\Omega$ |
| 134 | 1 M$\Omega$ |
| 136 | 2N2222 |
| 138 | 100 k$\Omega$ |
| 140 | 2N2222 |
| 142 | N-POWER MOSFET |

Figure 15B:
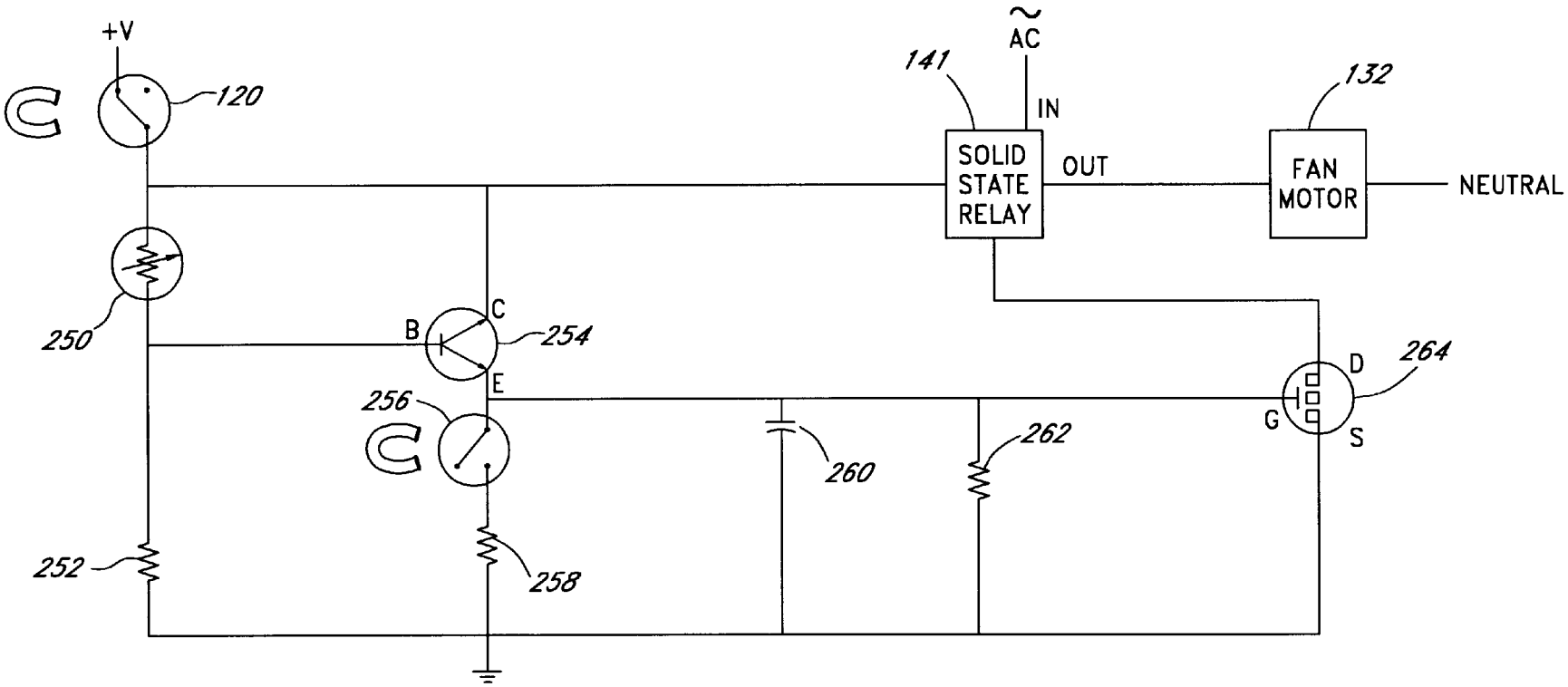
FIG. 15B is a circuit diagram illustrating another embodiment of a control system of the toilet of the invention, utilizing an odor detector.

FIG. 15B is an alternative electric circuit diagram that can be used in conjunction with an odor detecting chip, or odor detector, positioned near the toilet, preferably inside the toilet bowl. The illustrated circuit diagram can be used for an odor detector 250 whose resistance decreases when an odor of interest is detected. The circuit may need to be modified if the resistance of the odor detector increases when odors are detected. Those of ordinary skill in the art will understand that many different circuit configurations can be used, and that the illustrated circuit is only one example of a suitable configuration.

The illustrated circuit includes a seat cover switch 120, an odor detector 250, a transistor 254, a tank water level float switch 256, a power MOSFET 264, a solid state relay, a fan motor 132, a resistor 252, a capacitor rapid rate discharge/reset control resistor 258, a capacitor 260, and a capacitor slow rate discharge/time delay control resistor 262. Preferably, the odor detector 250 is configured to detect odors of human fecal matter. When such matter is detected, the odor detector 250 turns on the transistor 254, which in turn charges the capacitor 260 and turns on the power MOSFET 264. The power MOSFET 264 turns on the solid state relay 141, which supplies power to the fan motor 132. The capacitor slow rate discharge/time delay control resistor 262 can be selected to supply a delay, such as, for example 15 minutes. If human fecal odors are still detected after the delay, the circuit repeats the cycle. The circuit continuously repeats the cycle until the odor is not present. If the toilet is flushed during the delay, the tank water level float switch 256 activates the capacitor rapid rate discharge/reset control resistor 258 and shuts off the power MOSFET 264. This shuts off power to the fan motor 132.

One advantage of using an odor detector 250 over other types of sensors, such as a photosensor or weight-actuated sensor as described above, is that the toilet can be configured to activate the fan 90 only when human fecal matter is present in the toilet bowl. Activation of the fan 90 may be desirable only when unpleasant odors are present, such as the odors associated with human fecal matter, as opposed to the odors associated with urine. Other sensors activate the fan when a person sits on the toilet seat. However, in that instance, there may not be any need to activate the fan. For example, a female user may sit on the toilet seat only to urinate, in which case fan activation may not be desired. Thus, use of an odor detector 250 can prevent undesired fan activation.

The trap cover 50 can be comprised of any of a variety of materials, giving due consideration to the goals of long life and resistance to wear and tear in an underwater environment. Preferred materials include plexiglass, ABS, PVC, lexan, epoxy type resins, etc.

Thus, the toilet of the present invention provides odor-removing and water conserving capabilities in a simple, reliable, and user-friendly design. Advantageously, the number of moving parts is kept to a minimum, reducing the possibility of failure thereof.

FIGS. 16–20 illustrate an alternative embodiment of the tank interior assembly of the present invention, in which like reference numerals indicate components that are the same as or analogous to the embodiment of FIGS. 5–13.

Figure 16:
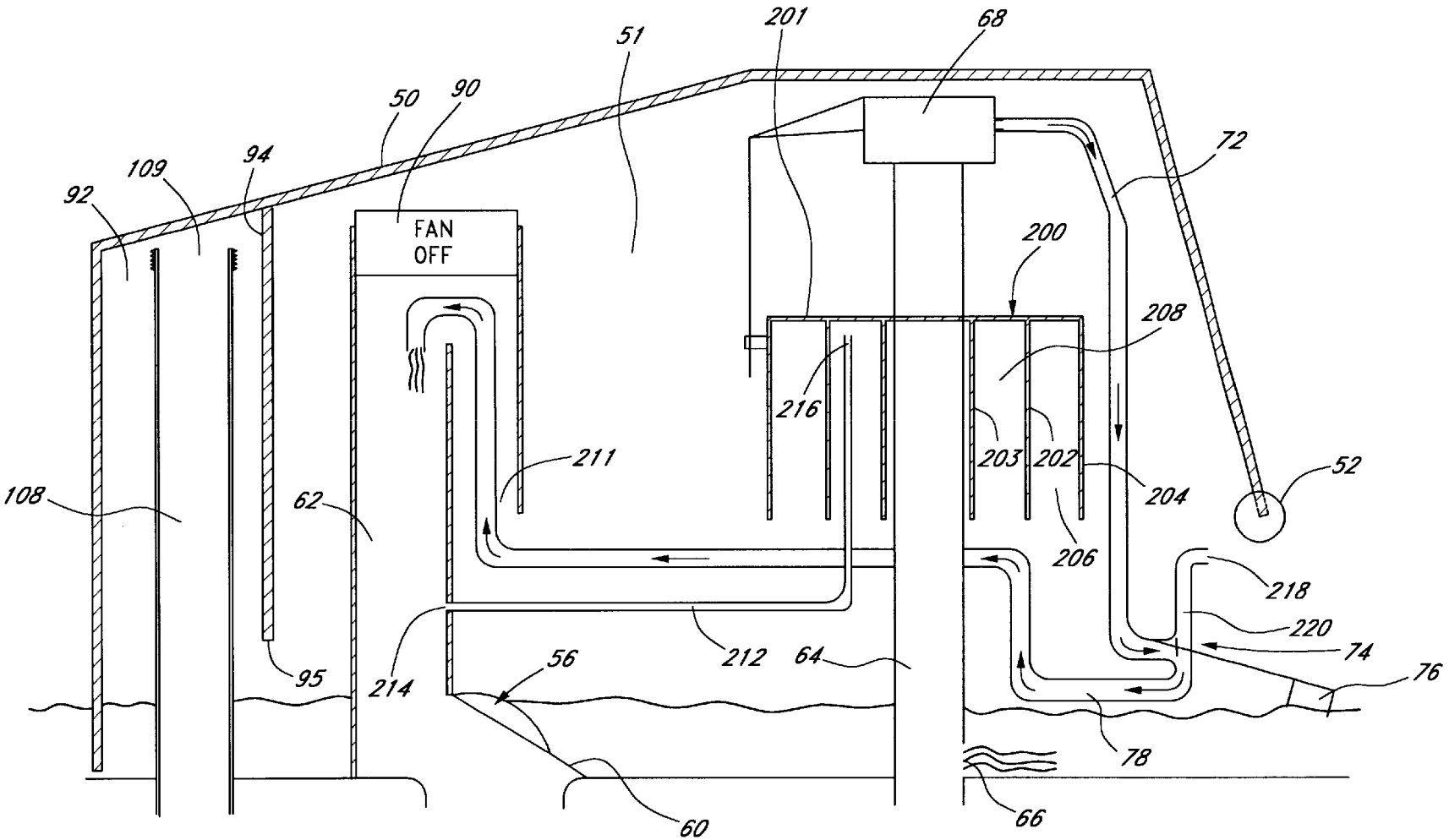
FIG. 16 is a schematic view of a tank assembly according to an alternative embodiment of the invention, shown during a tank filling process at a moment during which water flows into the toilet bowl.

With reference to FIG. 16, the float valve 68 is actuated by a float 200. The float 200 defines upper and side surfaces of a cavity. In the illustrated embodiment, the float 200 comprises an upper disc 201 having three annular flanges 202, 203, and 204 descending therefrom. An outer flange 204 descends from the periphery of the disc 201. An intermediate flange 202 is positioned within the flange 204. An inner flange 203 is positioned within the flange 202.

Such flanges can have any suitable shape, but are preferably cylindrical. The flanges 202 and 204 define an annular cavity 206 therebetween. Similarly, the flanges 202 and 203 define an annular cavity 208 therebetween. A venturi conduit 212, such as a flexible or rigid tube, has a first end 214 connected to a side wall of the air intake conduit 62 and a second end 216 terminating within the annular cavity 208.

In the illustrated embodiment, the bowl trap fill conduit 78 terminates in an upwardly oriented end 211 along an inner surface of the pipe 88. In a lowered position of the float 76, the diverter valve 74 channels water flow from the conduit 72 to the conduit 78. In a raised position of the float 76, the diverter valve 74 channels water flow into a secondary tank fill conduit 220 having an open end 218 within the tank 24. The illustrated embodiment does not include a dampening chamber or a dampening chamber fill conduit.

FIG. 16 illustrates the condition of the tank 24 after it is flushed and when water is beginning to fill the tank from the water supply. At this point, the float 200 is below the activation level associated with the float valve 68, causing the valve 68 to open. As shown, water enters the tank via the tank fill vent 66 and also flows through the conduit 72 to the diverter valve 74. Due to the low water level in the tank 24, the float 76 is in its lowered position, causing the water in the conduit 72 to flow into the toilet bowl fill conduit 78 to fill the trap 26 (FIG. 1) of the toilet bowl 22. Thus, when the float 76 is lowered, most of the water flowing into the tank 24 from the water supply fills the tank for a subsequent flush, but a portion of the water is diverted to the toilet bowl 22 to fill the trap 26.

Figure 17:
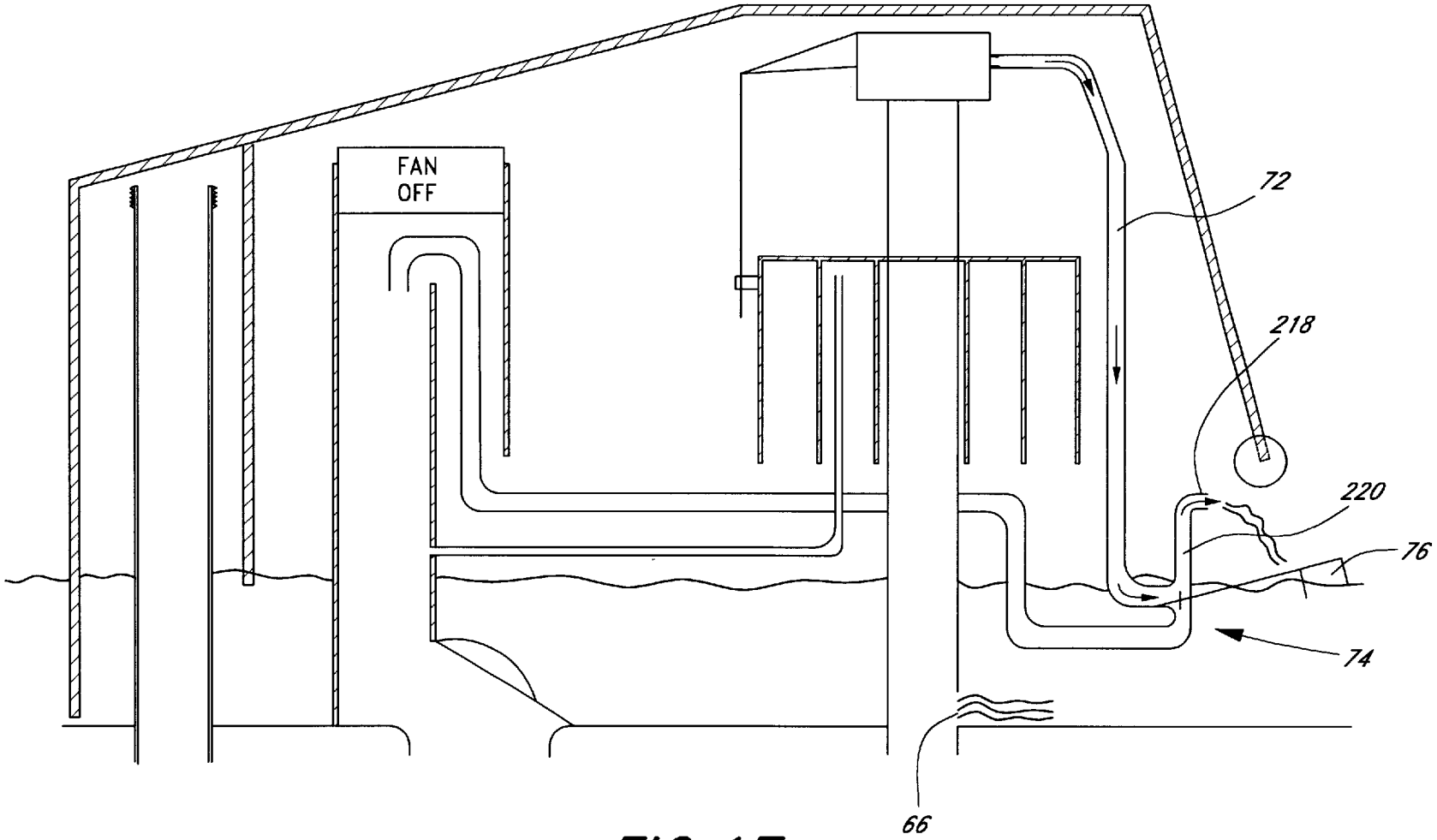
FIG. 17 is a schematic view of the tank assembly of FIG. 16, shown at a moment when water ceases to flow into the toilet bowl.

With reference to FIG. 17, as water continues to fill the tank 24, the float 76 rises, causing the diverter valve 74 to channel the water flow in the conduit 72 to the secondary tank fill conduit 220. The water discharges through the end 218 of the conduit 220 into the tank 24. Thus, when the float 76 is raised, all of the water flowing into the tank 24 from the water supply fills the tank for a flush, via the tank fill vent 66 and the secondary tank fill conduit 220.

Figure 18:
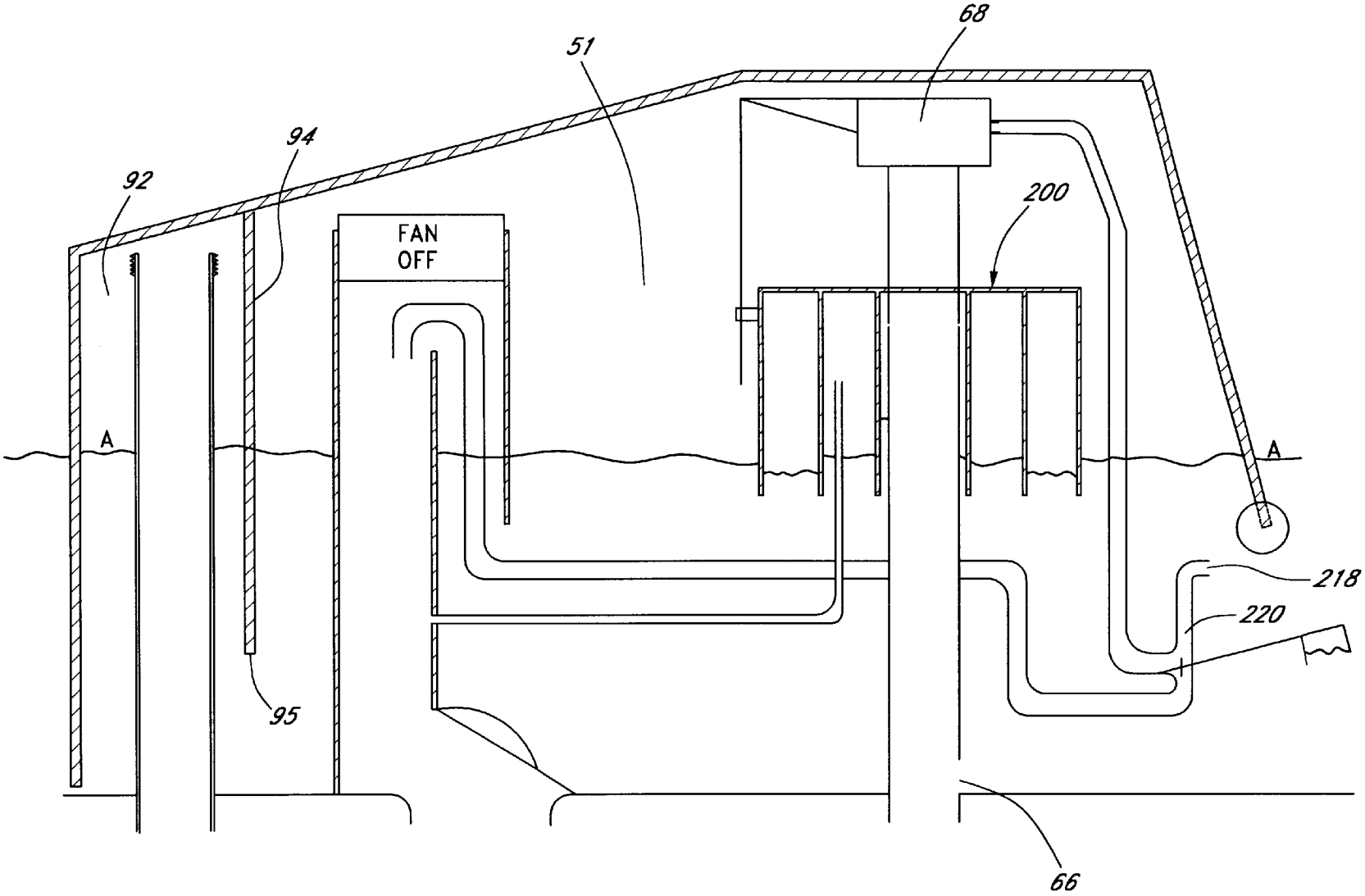
FIG. 18 is a schematic view of the tank assembly of FIG. 16, showing a stabilized low water volume condition of the tank.

With reference to FIG. 18, the water level in the tank 24 eventually reaches a level A, the activation level associated with the float valve 68. The float 200 rises to the shut off level associated with the float valve 68. Water ceases to fill the tank 24 via the tank fill vent 66 and the secondary tank fill conduit 220. The condition shown in FIG. 18 corresponds to a low water volume condition of the tank. Flushing of the toilet while in this condition will consume a relatively lower volume of water. Preferably, the low water volume of the tank 24 is within the range of 0.25–1.6 gallons or higher. The low water volume of the tank is preferably at most 1.5 gallons, even more preferably at most 1.4 gallons, even more preferably at most 1.3 gallons, even more preferably at most 1.25 gallons, even more preferably at most 1 gallon, even more preferably at most 0.75 gallons, even more preferably at most 0.5 gallons, and even more preferably at most 0.25 gallons.

As shown in FIG. 18, the water level A is above the lower end 95 of the separator 94 and forms a water trap seal between the main chamber 51 and the exhaust compartment 92. The UPC requires that the water trap seal comprise a minimum depth, such as two inches. In other words, the UPC requires that the vertical distance from the water level in the exhaust compartment 92 and the lower end 95 of the separator 94 be at least a minimum amount. Preferably, in the condition shown in FIG. 18, the water trap seal between the compartment 92 and the main chamber 51 is at least equal to the minimum depth required by the UPC.

Figure 19:
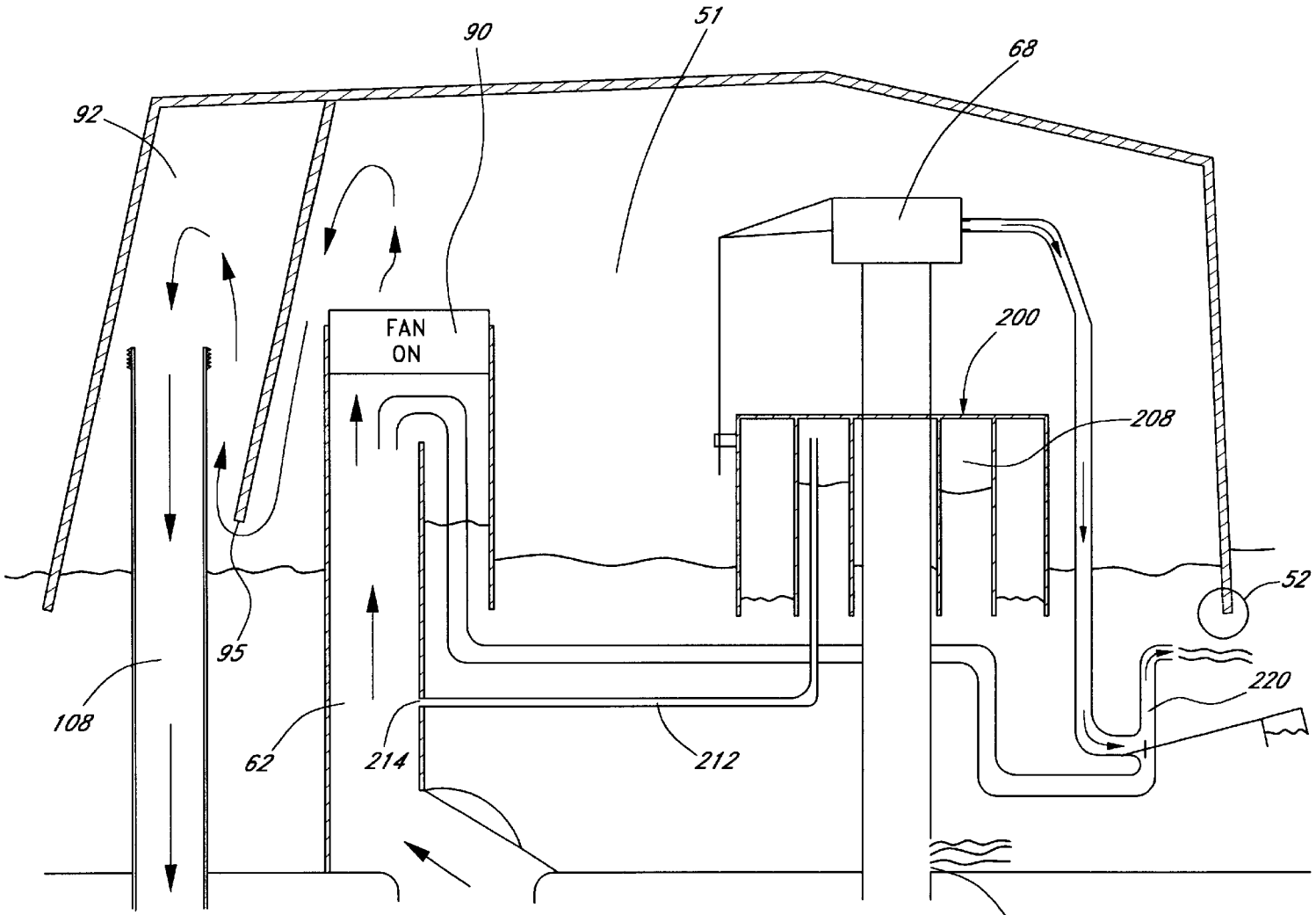
FIG. 19 is a schematic view of the tank assembly of FIG. 16, shown at a moment when the fan is initially activated.

With reference to FIG. 19, when a person sits on the toilet seat to activate the fan 90, the resultant air pressure increase in the main chamber 51 causes the trap cover 50 to pivot upward relatively quickly. In this embodiment, there is no dampening chamber to counteract the upward motion of the trap cover 50. The trap cover pivots upward to a point at which the lower end 95 of the separator 94 is above the water level in the main chamber 51. This permits air flow from the toilet bowl into the exhaust conduit 108 as described above. Advantageously, the toilet begins to remove gases from the toilet bowl area immediately when a person sits on the toilet seat, without the delay caused by the dampening chamber of the embodiment of FIGS. 5–13.

The air flow through the air intake conduit 62 causes a venturi effect at the end 214 of the venturi conduit 212. As a result, the air pressure in the annular cavity 208 decreases. The decrease in air pressure in the cavity 208 causes the water level therein to rise somewhat, and also causes the float 200 to descend, which in turn opens the float valve 68. Water from the water supply again enters the tank 24 via the tank fill vent 66 and the secondary tank fill conduit 220.

Preferably, the float 200 and the venturi conduit 212 are configured so that the water level in the cavity 208 remains below the upper end 216 of the venturi conduit 212. Preferably, the float 200 is configured so that the cavity 208 and the venturi conduit 212 extend vertically upward to a height sufficient to prevent the water in the cavity 208 from overflowing into the venturi conduit 212 through the upper end 216 thereof. In one embodiment, the ceiling of the cavity 208 is higher than the ceiling of the cavity 206. This permits the upper end 216 to be higher than the ceiling of the cavity 206.

Figure 20:
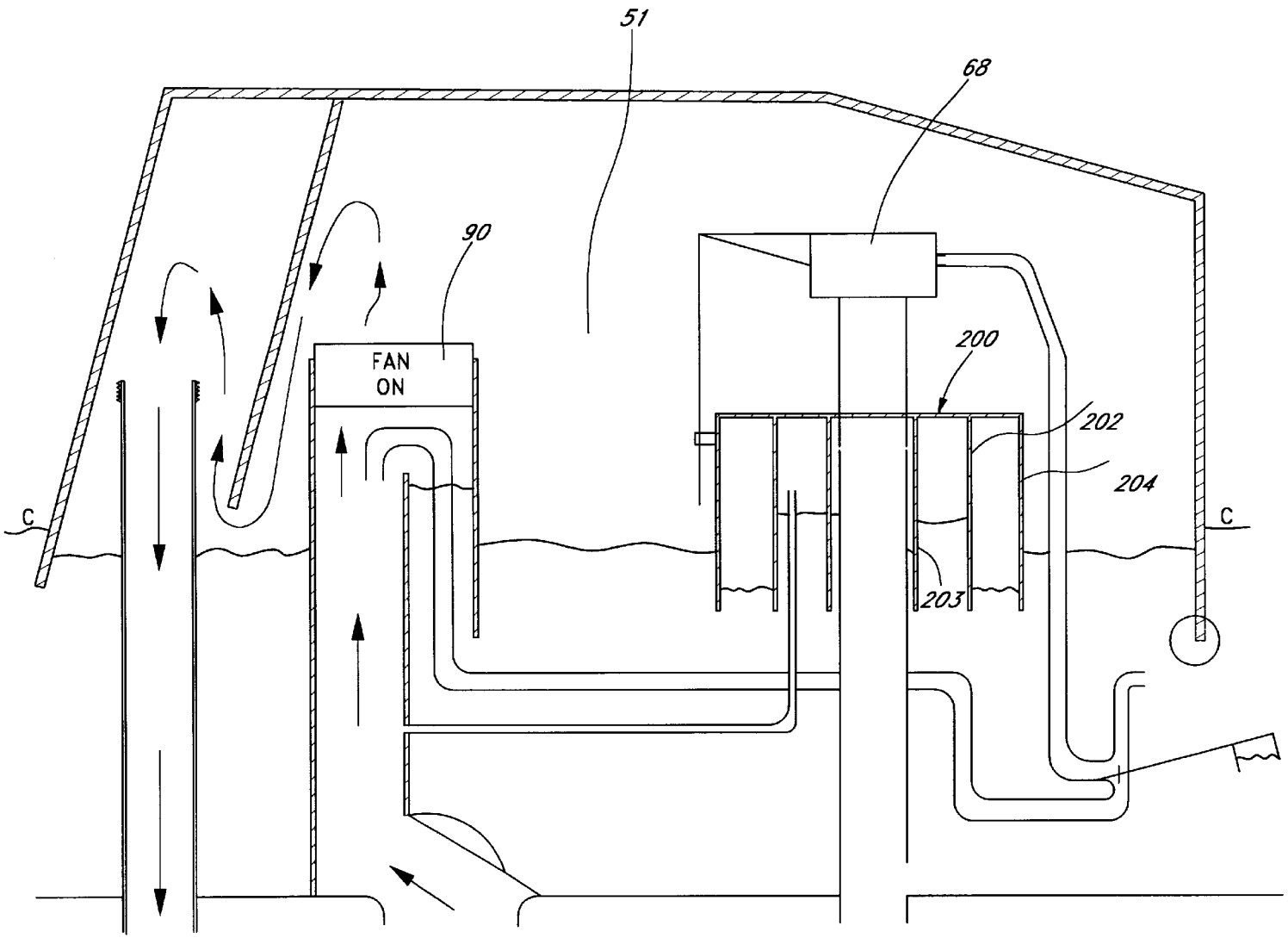
FIG. 20 is a schematic view of the tank assembly of FIG. 16, showing a stabilized high water volume condition of the tank while the fan is activated.

With reference to FIG. 20, the water level in the main chamber 51 continues to rise until the float 200 again reaches the activation level associated with the float valve 68. At that point, the float valve 68 shuts off, preventing water from entering the tank 24 from the water supply. At this point, the water level in the tank 24 (outside of the trap cover 50) is at a level C that is higher than the level A shown in FIG. 18. This condition corresponds to a stabilized high water volume of the tank 24. The high water volume is preferably at least 1.0 gallons, more preferably at least 1.3 gallons, even more preferably at least 1.6 gallons, and even more preferably the maximum that the UPC permits. The differential between the high water volume and the low water volume can be adjusted by varying the interior dimensions of the tank 24, the dimensions of the flanges 202, 203, and 204, and the rate of rotation of the fan 90.

Flushing of the toilet while in the condition of FIG. 20 will consume a relatively higher volume of water. If the fan 90 is deactivated without flushing the toilet, the trap cover 50 will pivot downward so that the lower end 95 of the separator 94 is below the water level in the chamber 51, reestablishing the trap seal between the chamber 51 and the exhaust compartment 92.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A toilet comprising:

a bowl having a lower opening configured to be fluidly connected to a sewer line;

a seat generally above said bowl;

a tank configured to contain water to flush matter within said bowl to said sewer line, said tank configured to be fluidly connected to a water supply;

an inlet valve configured to control a flow of water from the water supply into said tank; and a control system configured to control said inlet valve so that said tank contains a first stabilized volume of water before a person sits on said seat and a second stabilized volume of water after the person sits on said seat, said second volume being greater than said first volume, said control system configured such that the person's presence on said seat causes the volume of water within said tank to shift from said first volume to said second volume.

2. The toilet of claim 1, wherein said inlet valve comprises a float valve inside said tank, said float valve including a float, said float valve having an open position in which said float valve permits water from the water supply to enter said tank, said float valve having a closed position in which said float valve prevents water from the water supply from entering said tank, said float valve configured to be in said open position when said float is below a float valve activation level and in said closed position when said float is above said float valve activation level.

3. The toilet of claim 2, wherein said control system comprises:

a fan configured to draw air from said bowl into said tank; and a sensor configured to sense whether the person is sitting on said seat, said sensor being electrically connected to said fan so that said fan is activated when said sensor senses the person sitting on said seat.

4. The toilet of claim 3, wherein when said tank contains said first volume of water and said float valve is in said closed position, activation of said fan increases the air pressure above said float to cause the water level in the region of said float to decrease, said decrease in water level causing said float valve to switch to said open position for a period of time so that the water volume in said tank increases to said second volume.

5. The toilet of claim 3, wherein said float defines upper and side surfaces of a cavity, said toilet further comprising:

an air intake conduit having a first end in fluid communication with said bowl and a second end within said tank; and a venturi conduit having a first end connected to a side wall of said air intake conduit, said first end in fluid communication with said air intake conduit, and a second end within said cavity;

wherein when said tank contains said first volume of water and said float valve is in said closed position, activation of said fan causes airflow in said air intake conduit, said airflow causing a reduction in the air pressure in said cavity due to said venturi conduit, said reduction in air pressure causing said float to descend, said descent of said float causing said float valve to switch to said open position for a period of time so that the water volume in said tank increases to said second volume.

6. The toilet of claim 3, further comprising a trap cover within said tank, said trap cover comprising:

a container having an upper interior surface; and a separator connected to said container to divide the space within said container into a main chamber and an exhaust compartment;

wherein said trap cover has a first position in which a lower end of said separator extends downwardly into the water within said tank to seal said main chamber from said exhaust compartment, said trap cover having a second position in which said lower end of said separator is above the surface of the water in said tank to permit air flow between said main chamber and said exhaust compartment, wherein activation of said fan causes said trap cover to move to said second position due to an increase in the air pressure in said main chamber.

7. The toilet of claim 6, wherein said separator extends downwardly from said upper interior surface of said container.

8. The toilet of claim 6, further comprising a dampening mechanism configured to restrict the speed of motion of said trap cover from said first position to said second position.

9. The toilet of claim 6, wherein said trap cover further comprises a dampening chamber having a lower wall and a fluid port in said lower wall, said dampening chamber configured to receive water from said water supply, wherein water within said dampening chamber provides a weight that counteracts motion of said trap cover toward said second position, said weight decreasing as water drains from said dampening chamber through said fluid port.

10. The toilet of claim 9, further comprising a diverter valve in fluid communication with said inlet valve, said diverter valve having a first position in which said diverter valve channels water flowing through said inlet valve into said bowl, and a second position in which said diverter valve channels water flowing through said inlet valve into said dampening chamber, wherein when said tank begins to fill with water said diverter valve is in said first position thereof, said diverter valve being configured to switch to said second position thereof when the water level in said tank rises to a diverter valve activation level.

11. The toilet of claim 6, wherein said float is in said main chamber.

12. The toilet of claim 6, wherein said trap cover is pivotally secured to said tank so as to pivot between said first and second positions.

13. The toilet of claim 3, wherein said sensor comprises a photocell embedded within a surface of said seat.

14. The toilet of claim 1, further comprising a diverter valve in fluid communication with said inlet valve, said diverter valve having a first position in which said diverter valve channels water flowing through said inlet valve into said bowl, and a second position in which said diverter valve channels water flowing through said inlet valve to a location within said tank, wherein when said tank begins to fill with water said diverter valve is in said first position thereof, said diverter valve being configured to switch to said second position thereof when the water level in said tank rises to a diverter valve activation level.

15. The toilet of claim 14, wherein said diverter valve comprises a pivoting arm having a diverter valve float secured to an end thereof, said diverter valve being in said first position thereof when said diverter valve float is in a lowered position, said diverter valve being in said second position thereof when said diverter valve float is in a raised position.

16. A toilet comprising:

a bowl configured to be fluidly connected to a sewer line;

a tank configured to contain water to flush matter within said bowl into the sewer line;

a trap cover within said tank, said trap cover comprising a container having an open lower end, said container configured to fluidly divide air above the water level within said tank into an interior chamber within said container and an exterior chamber outside of said container, said container having a separator extending downward from a ceiling of said container, said separator fluidly dividing an upper portion of said interior chamber into a main chamber and an exhaust compartment, said container configured to pivot with respect to said tank, said container having a first position in which a lower edge of said separator is configured to extend to a level below the water level in said interior chamber so that air cannot flow from said main chamber to said exhaust compartment, said container having a second position in which said lower edge of said separator is configured to extend to a level above the water level in said interior chamber so that air can flow from said main chamber to said exhaust compartment;

an exhaust conduit having an inlet port in said exhaust compartment and an outlet port configured to fluidly communicate with the sewer line; and a fan assembly including a fan configured to draw air from said bowl into said main chamber;

wherein said container is in said first position when said fan is not activated, said container being in said second position when said fan is activated.

17. The toilet of claim 16, wherein said exhaust compartment is defined by side walls and also by said separator, said side walls having lower edges that are lower than the lower end of said separator, wherein in said first position of said container the lower edge of said separator is configured to extend to a depth of at least 2.0 inches below the water level in said interior chamber.

18. The toilet of claim 16, wherein said exhaust compartment is defined by side walls and also by said separator, said side walls having lower edges that are lower than the lower end of said separator, wherein in said first position of said container the lower edge of said separator is configured to extend to a depth below the water level in said interior chamber of at least the minimum required depth of a water seal required by the universal plumbing code.

19. A toilet comprising:

a bowl configured to fluidly communicate with a sewer line;

a seat generally above said bowl;

a tank configured to contain water to flush matter within said bowl into the sewer line, said tank including an inlet configured to be connected to a water supply;

an inlet valve configured to control the flow of water into said tank from the water supply, said inlet valve configured to be controlled by a user so that the volume of water within the tank can be selectively varied between different stabilized volumes of water;

a control assembly configured such that the user's presence on said seat causes the volume of water within said tank to shift from a first stabilized volume to a second stabilized volume; and a fan assembly including a fan, said fan assembly configured to draw air from said bowl to said sewer line when said fan is activated.

20. The toilet of claim 19, wherein said first volume is less than or equal to 1.5 gallons and said second volume is greater than or equal to 1.6 gallons.

21. The toilet of claim 19, wherein said first volume is less than or equal to 1.5 gallons and said second volume is approximately equal to the maximum volume per flush allowed by the universal plumbing code.

22. The toilet of claim 19, further comprising:

a sensor configured to sense the presence of a user sitting on said seat and to send an output signal to said control system, said control system controlling said inlet valve such that when said sensor senses a user sitting on said seat said inlet valve sets the water volume in said tank to said first volume, and when said sensor does not sense a user sitting on said seat said inlet valve sets the water volume in said tank to said second volume.

23. The toilet of claim 19, said inlet valve comprising a float valve having an open position in which said float valve permits water from said water supply to enter said tank, and a closed position in which said float valve substantially prevents water from entering said tank, said float valve comprising a float defining upper and side walls of a cavity, said float valve being in said open position when said float is below a float valve activation level, said float valve being in said closed position when said float is at or above said float valve activation level, said toilet further comprising:

an air conduit, said fan assembly configured to generate airflow in said air conduit; and a venturi tube having a first end connected to a side wall of said air conduit, and a second end within said cavity of said float, said first end of said venturi tube being in fluid communication with said air conduit; and wherein when the water level in said tank is at said float valve activation level, activation of said fan causes airflow within said air conduit, said airflow causing the air pressure in said cavity of said float to decrease due to said venturi tube, said decrease in air pressure causing said float to descend, said descent of said float causing said float valve to open to permit water to enter said tank from said water supply.

24. The toilet of claim 23, wherein said air conduit has a first end in fluid communication with said bowl and a second end configured to be in fluid communication with an exhaust conduit that is configured to be connected to the sewer line.

25. A toilet comprising:

a bowl having a lower opening configured to be fluidly connected to a sewer line;

a seat generally above said bowl;

a tank configured to contain water to flush matter within said bowl to said sewer line, said tank configured to be fluidly connected to a water supply;

an inlet valve configured to control the flow of water from the water supply into said tank, said inlet valve comprising a float valve inside said tank, said float valve including a float, said float valve having an open position in which said float valve permits water from the water supply to enter said tank, said float valve having a closed position in which said float valve prevents water from the water supply from entering said tank, said float valve configured to be in said open position when said float is below a float valve activation level and in said closed position when said float is above said float valve activation level; and a control system configured to control said inlet valve so that said tank contains a first stabilized volume of water before a person sits on said seat and a second stabilized volume of water after the person sits on said seat, said second volume being greater than said first volume, said control system comprising:

a fan configured to draw air from said bowl into said tank; and a sensor configured to sense whether the person is sitting on said seat, said sensor being electrically connected to said fan so that said fan is activated when said sensor senses the person sitting on said seat;

wherein when said tank contains said first volume of water and said float valve is in said closed position, activation of said fan increases the air pressure above said float to cause the water level in the region of said float to decrease, said decrease in water level causing said float valve to switch to said open position for a period of time so that the water volume in said tank increases to said second volume.

26. A toilet comprising:

a bowl having a lower opening configured to be fluidly connected to a sewer line;

a seat generally above said bowl;

a tank configured to contain water to flush matter within said bowl to said sewer line, said tank configured to be fluidly connected to a water supply;

an inlet valve configured to control the flow of water from the water supply into said tank, said inlet valve comprising a float valve inside said tank, said float valve including a float, said float valve having an open position in which said float valve permits water from the water supply to enter said tank, said float valve having a closed position in which said float valve prevents water from the water supply from entering said tank, said float valve configured to be in said open position when said float is below a float valve activation level and in said closed position when said float is above said float valve activation level;

a control system configured to control said inlet valve so that said tank contains a first stabilized volume of water before a person sits on said seat and a second stabilized volume of water after the person sits on said seat, said second volume being greater than said first volume, said control system comprising:

a fan configured to draw air from said bowl into said tank; and a sensor configured to sense whether the person is sitting on said seat, said sensor being electrically connected to said fan so that said fan is activated when said sensor senses the person sitting on said seat; and a trap cover within said tank, said trap cover comprising:

a container having an upper interior surface; and a separator connected to said container to divide the space within said container into a main chamber and an exhaust compartment;

wherein said trap cover has a first position in which a lower end of said separator extends downwardly into the water within said tank to seal said main chamber from said exhaust compartment, said trap cover having a second position in which said lower end of said separator is above the surface of the water in said tank to permit air flow between said main chamber and said exhaust compartment, wherein activation of said fan causes said trap cover to move to said second position due to an increase in the air pressure in said main chamber.

27. The toilet of claim 26, wherein said separator extends downwardly from said upper interior surface of said container.

28. The toilet of claim 26, further comprising a dampening mechanism configured to restrict the speed of motion of said trap cover from said first position to said second position.

29. The toilet of claim 26, wherein said trap cover further comprises a dampening chamber having a lower wall and a fluid port in said lower wall, said dampening chamber configured to receive water from said water supply, wherein water within said dampening chamber provides a weight that counteracts motion of said trap cover toward said second position, said weight decreasing as water drains from said dampening chamber through said fluid port.

30. The toilet of claim 29, further comprising a diverter valve in fluid communication with said inlet valve, said diverter valve having a first position in which said diverter valve channels water flowing through said inlet valve into said bowl, and a second position in which said diverter valve channels water flowing through said inlet valve into said dampening chamber, wherein when said tank begins to fill with water said diverter valve is in said first position thereof, said diverter valve being configured to switch to said second position thereof when the water level in said tank rises to a diverter valve activation level.

31. The toilet of claim 26, wherein said float is in said main chamber.

32. The toilet of claim 26, wherein said trap cover is pivotally secured to said tank so as to pivot between said first and second positions.

33. A toilet comprising:

a bowl having a lower opening configured to be fluidly connected to a sewer line;

a seat generally above said bowl;

a tank configured to contain water to flush matter within said bowl to said sewer line, said tank configured to be fluidly connected to a water supply;

an inlet valve configured to control the flow of water from the water supply into said tank;

a control system configured to control said inlet valve so that said tank contains a first stabilized volume of water before a person sits on said seat and a second stabilized volume of water after the person sits on said seat, said second volume being greater than said first volume; and a diverter valve in fluid communication with said inlet valve, said diverter valve having a first position in which said diverter valve channels water flowing through said inlet valve into said bowl, and a second position in which said diverter valve channels water flowing through said inlet valve to a location within said tank, wherein when said tank begins to fill with water said diverter valve is in said first position thereof, said diverter valve being configured to switch to said second position thereof when the water level in said tank rises to a diverter valve activation level.

34. The toilet of claim 33, wherein said diverter valve comprises a pivoting arm having a diverter valve float secured to an end thereof, said diverter valve being in said first position thereof when said diverter valve float is in a lowered position, said diverter valve being in said second position thereof when said diverter valve float is in a raised position.

35. A toilet comprising:

a bowl configured to fluidly communicate with a sewer line;

a tank configured to contain water to flush matter within said bowl into the sewer line, said tank including an inlet configured to be connected to a water supply;

an inlet valve configured to control the flow of water into said tank from the water supply, said inlet valve configured to be controlled by a user so that the volume of water within the tank can be selectively varied between different stabilized volumes of water, said inlet valve being controllable to selectively set the volume of water in said tank at one of a first volume and a second volume, said second volume being greater than said first volume;

a fan assembly including a fan, said fan assembly configured to draw air from said bowl to said sewer line when said fan is activated a seat generally above said bowl; and a sensor configured to sense the presence of a user sitting on said seat, said sensor controlling said inlet valve such that when there is no user sitting on said seat said inlet valve sets the water volume in said tank to said first volume, and when a user is sitting on said seat said inlet valve sets the water volume in said tank to said second volume.

* * * * *